US007125371B2

(12) United States Patent
Henderson

(10) Patent No.: US 7,125,371 B2
(45) Date of Patent: Oct. 24, 2006

(54) ADJUSTABLE BODYWEIGHT EXERCISE APPARATUS

(76) Inventor: Alasdair David Henderson, The Old Cider House, Back Street, West Camel, Yeovil, Somerset (GB) BA22 7QF ( * ) Notice: Subject to any disclaimer, the term of this patent is extended or adjusted under 35 U.S.C. 154(b) by 96 days.

(21) Appl. No.: 10/876,317

(22) Filed: Jun. 24, 2004

(65) Prior Publication Data

US 2005/0003938 A1 Jan. 6, 2005

(51) Int. Cl.
*A63B 26/00* (2006.01)

(52) U.S. Cl. ..... 482/142; 482/143; 482/144

(58) Field of Classification Search ..... 482/141–144, 482/23–38, 62, 69; D21/665, 671, 686
See application file for complete search history.

(56) References Cited

U.S. PATENT DOCUMENTS

| | | | | |
|---|---|---|---|---|
| 3,759,511 | A | 9/1973 | Zinuin et al. | |
| 4,334,675 | A | 6/1982 | Parry et al. | |
| 4,431,181 | A | 2/1984 | Baswell | |
| 4,461,287 | A | 7/1984 | Takahashi | |
| 5,125,884 | A | 6/1992 | Weber et al. | |
| 5,674,168 | A | 10/1997 | Wilkinson | |
| 5,711,749 | A * | 1/1998 | Miller | 482/135 |
| 6,123,653 | A | 9/2000 | Huang | |
| 6,244,995 | B1 | 6/2001 | Prsala | |
| 2003/0216232 | A1 * | 11/2003 | Leftheriotis | 482/142 |
| 2004/0157713 | A1 * | 8/2004 | Kweon | 482/144 |

FOREIGN PATENT DOCUMENTS

| | | | |
|---|---|---|---|
| GB | 2163358 A | * | 2/1986 |
| GB | 2372711 A | | 9/2002 |
| GB | 2382035 A | | 5/2003 |

* cited by examiner

*Primary Examiner*—Lori Amerson

(57) ABSTRACT

An adjustable apparatus for performing bodyweight exercises comprises a pair of side frames. At least one pair of handles projects in forwards directions from the side frames. Handles in positions on the side frames allow different bodyweight exercises to be performed. A pendulous member for supporting the lower part of the body of a user in some exercises is suspended in the opening between the side frames. This may be raised and lowered between and secured at different height positions. Some embodiments may further comprise cushioned members at the base for the user's comfort. Additional detachable cross bars and a body support strap may be attached to the handles or structure of some embodiments to allow further variation in exercises. Further embodiments may allow folding or collapsing for storage.

20 Claims, 25 Drawing Sheets

ADJUSTABLE BODYWEIGHT EXERCISE APPARATUS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The present invention relates to exercise apparatus for use in performing bodyweight exercises.

2. Background of the Invention

The use of bodyweight exercises is increasingly recognised as one of the most effective methods of developing and maintaining a person's functional fitness and strength. There are certain bodyweight exercises, including push ups, decline and incline push ups, dips, assisted dips, chin ups, assisted chin ups, bodyweight rows, abdominal and lower back exercises, leg squats and variations thereon, which may be considered fundamental.

Whilst many of the bodyweight exercises described above may be carried out with various pieces of equipment found in gymnasiums or the home, the prior art does not reveal a piece of equipment on which a person can do them all. A single person requiring several pieces of equipment for bodyweight exercises can cause inconvenience to other gym users. Alternatively an individual may be personally inconvenienced by spending time setting up equipment or waiting for it to become available to use. A person requiring several pieces of equipment for a circuit of bodyweight exercises also requires more space than would be the case with using a single apparatus.

Additionally, as equipment used for bodyweight exercises is often not specifically designed for that purpose, it may lack usability and versatility. By way of example, bodyweight rows, where an individual uses the muscles of the arms and back to lift his or herself, are usually performed by holding a horizontal bar such as 'Smith' machine bar, with feet on the floor or on an exercise ball. As the individual pulls themselves up towards the bar, their feet should be able to move to compensate and therefore allow a full and fluid exercise movement. If the individual has to keep their feet in one position on the floor it is difficult to achieve a full and fluid range of movement, with their feet on a ball, it is only marginally less so. Furthermore, the choice of angle for the exercise, and thus the emphasis on different muscle groups, is limited to either the angle created by keeping the feet on the floor, or that created by keeping the feet on the exercise ball.

A further example of an exercise that lacks specific equipment is decline push ups. To perform these, a person usually places their feet in a position above their head, such as against a wall, or on wall bars. This is often an unsatisfactory arrangement as the exercise movement is not fluid, nor is it easy to achieve a full range of movement. The person's feet are forced to remain in one position, yet the exercise demands a compensating movement as the distance between the person's hands and feet changes during the performance of the exercise. There are similar difficulties with performing push ups, incline push ups, assisted dips and assisted chin ups.

Many people, particularly when commencing an exercise regime, or undergoing physical rehabilitation do not possess adequate strength or fitness to perform the bodyweight exercises described above without some form of assistance. Additionally there are those who may need assistance in exercising using their bodyweight because their muscles are tiring during a workout. Many known apparatus used for bodyweight exercises such as push up handles, chin up bars, and dip bars do not provide assistance for users. If the user cannot lift their entire bodyweight these apparatus are of no use to them. Apparatus, for example 'multi gyms', that do have means to assist in bodyweight exercises, such as counterweight systems, tend to be complex and heavy. Thus there is a need for apparatus that can provide assistance to a user performing bodyweight exercises, whilst at the same time remaining relatively simple, and avoiding the use of heavy counterweight systems and their accompanying complexity.

A characteristic of much known exercise apparatus for circuit and strength training, such as for example, home multi gyms, exercise stations in fitness centres, inclinable sliding boards and weight benches, is the requirement for the user to sit or lie down whilst exercising. At a time when many people lead sedentary lifestyles in the workplace and at home there is a need for strength and circuit training apparatus that largely avoids requiring the user to sit or lie down while exercising. This is particularly important because it is recognised in the fitness community that one of the most effective methods of building balanced fitness and strength is through exercising a user's stabilising muscles, particularly the abdominal and spinal erector muscles. Exercising these muscles is particularly crucial in helping prevent the poor posture and lower back pain associated with sedentary lifestyles, and these muscles tend not to be effectively utilised when exercising in a seated or lying position.

Additionally, where a user has to stabilise themselves during exercise, many more muscle groups are involved and thus developed than is the case where the user is in a supported position using a fixed trajectory resistance, such as with a 'multi gym'. There are therefore considerable benefits associated with apparatus that ensure the user is required to stabilise themselves whilst exercising—a more effective workout, with associated greater time efficiency, and balanced muscular development.

A further characteristic of much known exercise apparatus for circuit and strength training, such as home 'multi gyms' and fixed trajectory resistance exercise stations in fitness centres, is that the user is often limited to exercising specific muscle groups in isolation from others. A disadvantage in training muscle groups in isolation, using such apparatus as described above, is that imbalances of strength or fitness between different muscle groups may be created. Such imbalances are known to increase the risk of injury to the body.

Additionally, in an era where people are ever busier, a major disadvantage with training muscle groups in isolation is that the user requires more time to complete a full body workout than is the case where multiple muscle groups are exercised simultaneously using bodyweight exercises. There are therefore further advantages to be gained from an exercise apparatus for exercising multiple muscle groups in synergy.

Military personnel on deployments may go without proper exercise equipment due to constraints of space and weight caused by the incumbent disadvantages of much known strength and fitness training apparatus. The majority of such apparatus is heavy and bulky, often due to weights being used to provide resistance, which can make transportation and storage of the apparatus difficult. Additionally complex apparatus can be time consuming to set up and, if necessary, dismantle and often requires considerable space to be exclusively dedicated to their use. Furthermore, servicing of complex apparatus can be problematic in operational situations. A readily transportable, robust and low maintenance apparatus for bodyweight exercises (which are of particular relevance to military personnel) would be of great value to military personnel in helping develop and maintain their functional fitness requirements on operations.

In an age when many people have exercise equipment at home, there is a need for relatively lightweight and simple (when compared to home multi gyms with weight stacks) strength training apparatus to meet the needs of those who may live in apartments, or who move home frequently. Existing apparatus that use weights may be inconvenient to install or move for such persons.

The main advantage of the choice of resistance levels that are available with 'multi gyms' and fixed trajectory resistance exercise stations is substantially diminished if an apparatus for bodyweight exercises can be provided with a system for assisting the user.

BACKGROUND OF THE INVENTION—OTHER PRIOR ART

There are many patented or published inventions for exercise purposes. The following prior art has been cited by the United Kingdom Patent Office; and are discussed with reference to their limitations as regards the objects and advantages of this invention.

U.S. Pat. No. 3,759,511 to Zinkin et al (1973) discloses a device for simulating running. This device is solely for exercising the legs, relies on a friction device to provide resistance, and does not facilitate the following bodyweight exercises; push ups, decline and incline push ups, dips, assisted dips, chin ups, assisted chin ups, bodyweight rows, abdominal and lower back exercises, leg squats and variations thereon.

U.S. Pat. No. 4,334,675 to Parry et al (1982) discloses a device for gymnastic training and performance. The device is not specifically designed for or usable for the majority of bodyweight exercises above, chin ups excepted, and has no means of assistance for the user.

U.S. Pat. No. 4,461,287 to Takahashi (1984) discloses a portable exercise and traction device. This device is for therapeutic traction, specifically of the spine and lower back. While it could conceivably be used for abdominal and lower back exercises, it does not facilitate the majority of bodyweight exercises listed above.

U.S. Pat. No. 4,431,181 to Baswell (1984) discloses a collapsible gym apparatus. When in use, this device relies primarily on weights and pulleys to provide training resistance for the user, is therefore relatively complex and generally designed for isolation exercises, such as bench presses. Though it has provision for some unassisted bodyweight exercises, such as dips and chin ups, it lacks integral means of performing other bodyweight exercises; including push ups, decline and incline push ups, assisted dips, assisted chin ups, bodyweight rows, abdominal and lower back exercises, squats and variations thereon.

UK Patent Application GB 2 163 358 by Mojden (1986) discloses a device limited to use for dips and chin ups. This device however lacks an integral means of assisting the user to perform these exercises. Additionally this device does not provide integral means for push ups, decline and incline push ups, bodyweight rows, abdominal and lower back exercises, squats and variations thereon.

U.S. Pat. No. 5,125,884 to Weber et al (1992) discloses an adjustable device primarily aimed at the exercise of abdominal muscles, but with some rehabilitative uses such as elongation of the spine. This device is not designed for or capable of use for the majority of bodyweight exercises above.

U.S. Pat. No. 5,674,168 to Wilkinson (1997) discloses a multiple exercise device but one that is limited to squat and rowing exercises, and does not incorporate the means to do the full range of bodyweight exercises described above. In addition the resistance on this device for rowing exercises is provided by means such as hydraulic cylinders or friction brake mechanisms, which may be considered complex, and do not provide a strictly bodyweight exercise. The user is also required to rest on a slant board when performing the exercises, thus limiting the use of the stabilising muscles of the lower back and abdomen. The exercise and development of these muscle groups are crucial to preventing posture problems, and are underused on any equipment when the user is primarily required to sit or lie down to exercise.

U.S. Pat. No. 6,123,653 to Huang (2000) discloses a multifunctional sit-up exerciser, but this device is limited to being used for sit-ups, with no provision for other bodyweight exercises.

U.S. Pat. No. 6,244,995 B1 to Prsala (2001) discloses a device for general physical fitness and posture. It does not however provide for the performance of the bodyweight exercises described above, specifically push ups, decline and incline push ups, dips, assisted dips, chin ups, assisted chin ups, bodyweight rows, abdominal and lower back exercises, leg squats and variations thereon.

UK Patent Application GB 2 372 711 A by Wilson (2002) discloses a device for bodyweight exercise and traction. This device is not designed for or usable for the bodyweight exercises described above, specifically it has no provision for push ups, decline and incline push ups, dips, assisted dips, chin ups, assisted chin ups, bodyweight rows, abdominal and lower back exercises, leg squats and variations thereon.

UK Patent Application GB 2 382 035 A by Wilson (2003) discloses an exercise swing. This device is not designed for or usable for the bodyweight exercises described above. In addition it may be considered complex for the purpose intended and requires the user to be seated to exercise.

Other designs of fitness equipment for bodyweight exercises, and their limitations, to be considered under the prior art include Chin up/Dip/Hip Raise stations, sometimes referred to as 'Power Towers'. However these do not provide for incline or decline push ups, bodyweight rows, lower back exercises, leg squats and variations thereon, nor include satisfactory means of assistance for chin up or dip exercises. Their uses are thus limited for persons who cannot lift their entire bodyweight.

BACKGROUND OF INVENTION—ADVANTAGES

Accordingly the apparatus of the present invention may have one or more of the following advantages;

(a) a user may perform at least the following exercises on the apparatus; push ups, assisted push ups, decline and incline push ups, dips, assisted dips, bodyweight rows, assisted chin ups, abdominal curls, hip raises, one legged squats and lunge type exercises;

(b) the apparatus may save the user time by being more rapid and straightforward to configure for the exercises above than may be the case with using several pieces of existing equipment;

(c) the apparatus may save space by allowing the user to perform a range of bodyweight exercises on one piece of equipment, where previously several pieces of equipment may have been required;

(d) the apparatus may compensate for any changing distance between a user's hands and feet during various bodyweight exercises, thereby give fluidity in exercise movements and a full range of movement;

(e) the apparatus may allow a user to readily incline or decline the angle of their body thereby changing emphasis between different muscle groups in various bodyweight exercises;

(f) the apparatus may support part of the user's bodyweight in a manner that assists the user to perform various exercises thereby allowing use by persons who may not be able to lift their entire bodyweight and so may aid progressive and rehabilitative training;

(g) by providing exercises where a user does not either sit or lie down the apparatus may help ensure the user engages their abdominal and lower back muscle groups and thereby may help prevent problems often associated with weakness in those muscle groups;

(h) the apparatus may require users to stabilize themselves while performing some of the exercises thereby help balanced fitness and strength development;

(i) by using the bodyweight of the user to provide resistance or assistance in many exercises the apparatus may avoid the need for other weight or counterweight systems, thereby reducing complexity, maintenance requirements, and overall weight of the apparatus and thus offering particular benefits to the military on operations for example;

(j) the apparatus may be accessible to a wide range of users of differing body sizes, physiques and fitness ability with minimal adjustment;

Further advantages of my invention may become apparent from a consideration of the drawings and ensuing description.

SUMMARY

In accordance with the present invention, the apparatus for performing bodyweight exercises, when set up for use comprises a pair of side frames in a secure opposed relationship whereby permitting a user to exercise in the opening between the side frames. At least one pair of handles project in substantially forward directions relative to the side frames. A plurality of handle positions on the side frames allow different bodyweight exercises to be performed. A member for supporting the lower part of the body of a user in certain exercises is suspended in the opening between the side frames.

Strut. In accordance with MPEP 2111.01 the use of the term 'strut' in the specification (as is apparent) is not intended to be restricted to a specific engineering definition of 'a structural element designed to resist longitudinal compression'. Instead Applicant intends that 'strut' is interpreted as a general term interchangeable with 'structural member' and meaning a structural member of one or several elements providing strength or support to the structure or its use.

DRAWINGS

Figure 1:
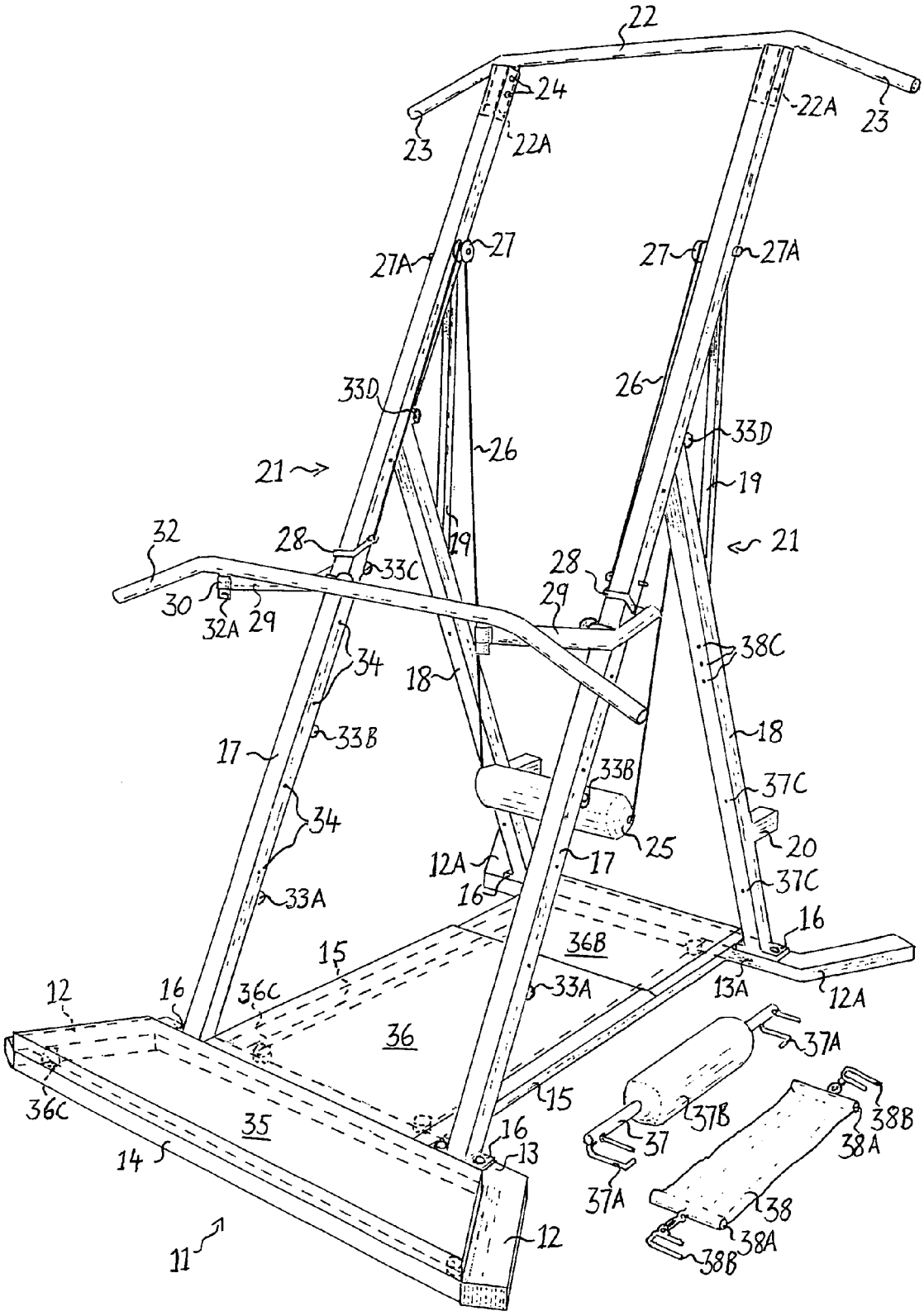
FIG. 1 is a perspective view of one embodiment of the apparatus of the present invention.
Figure 3A:
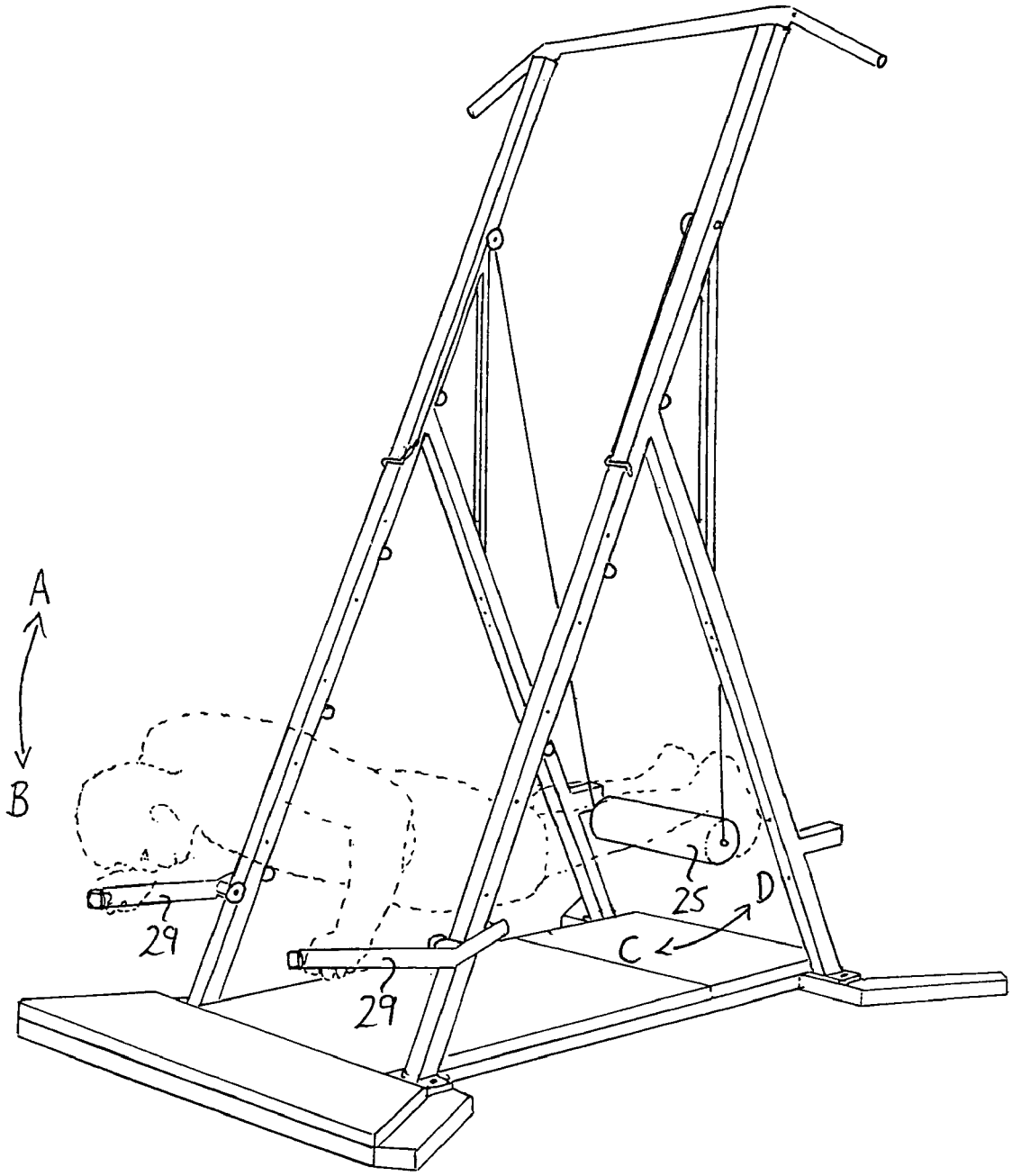
Figure 3B:
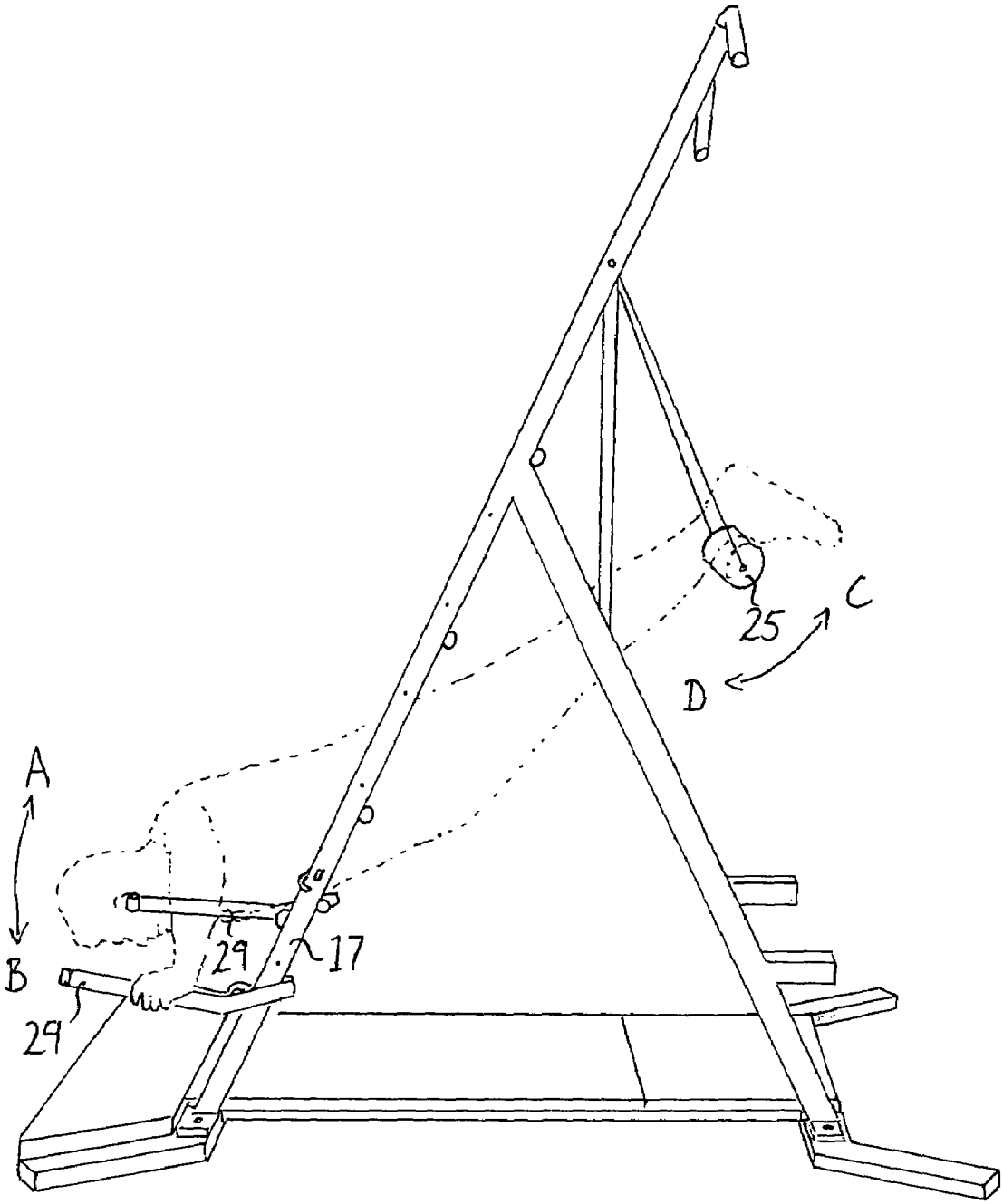
Figure 3C:
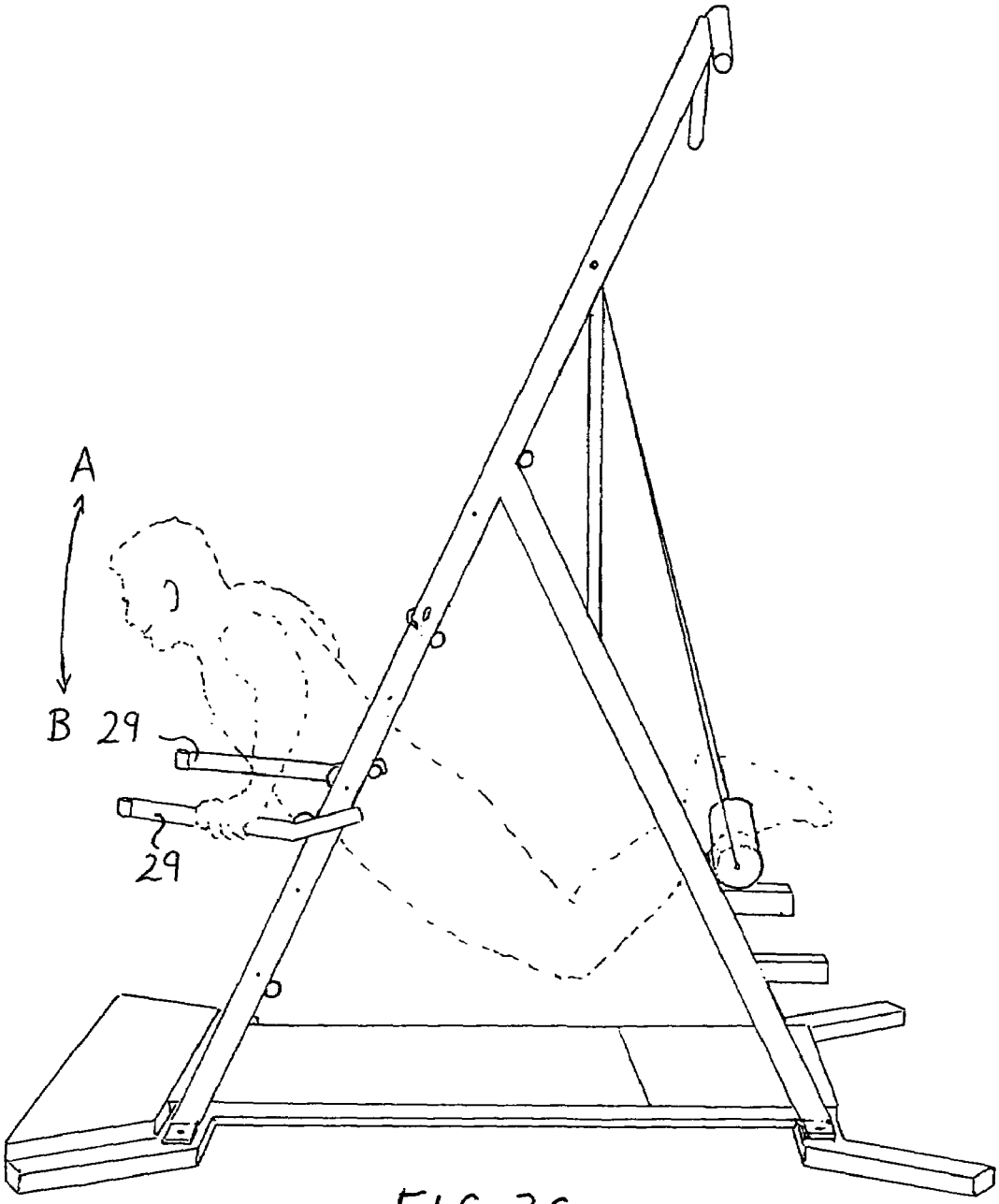
Figure 3D:
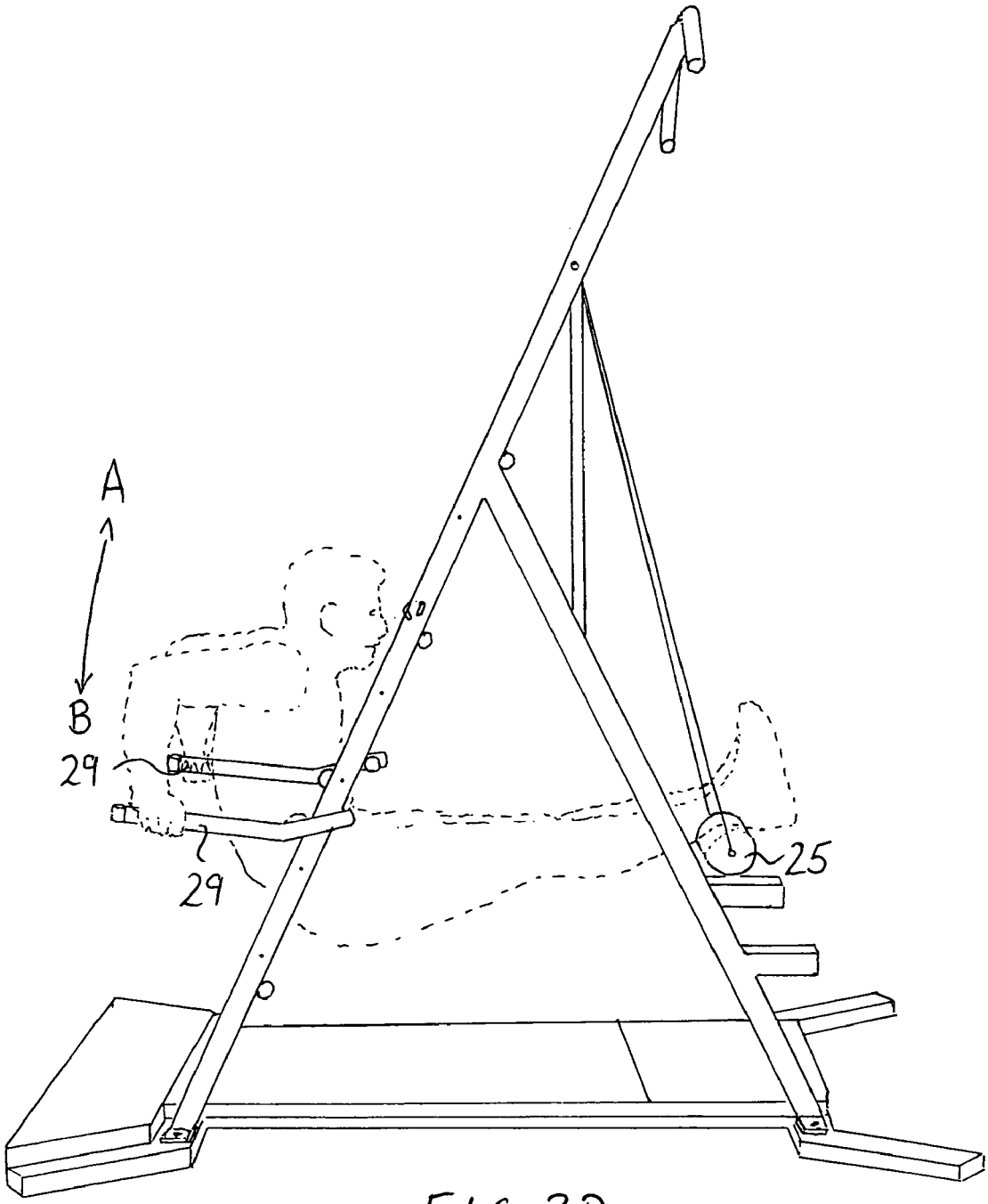
Figure 3E:
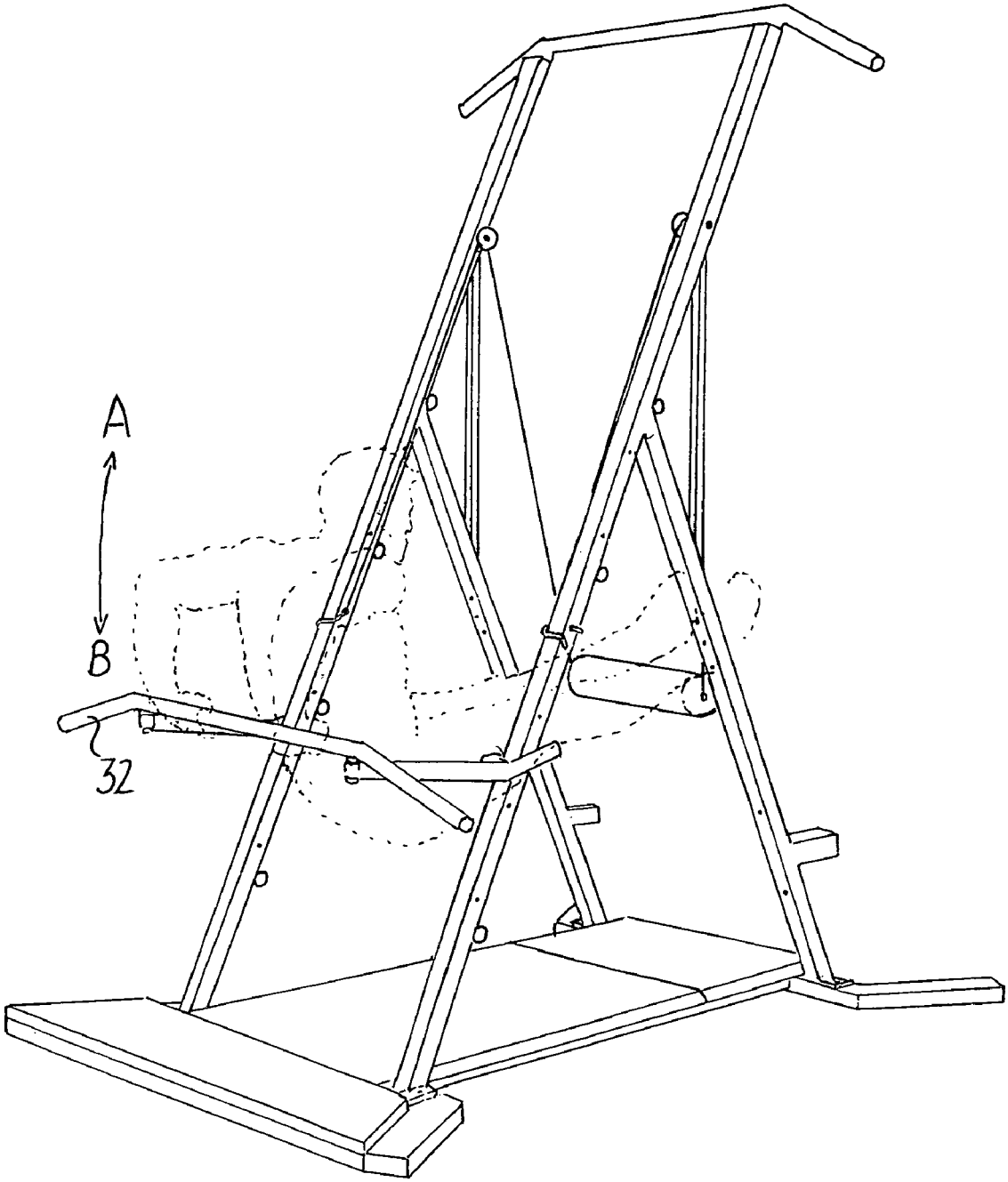
Figure 3F:
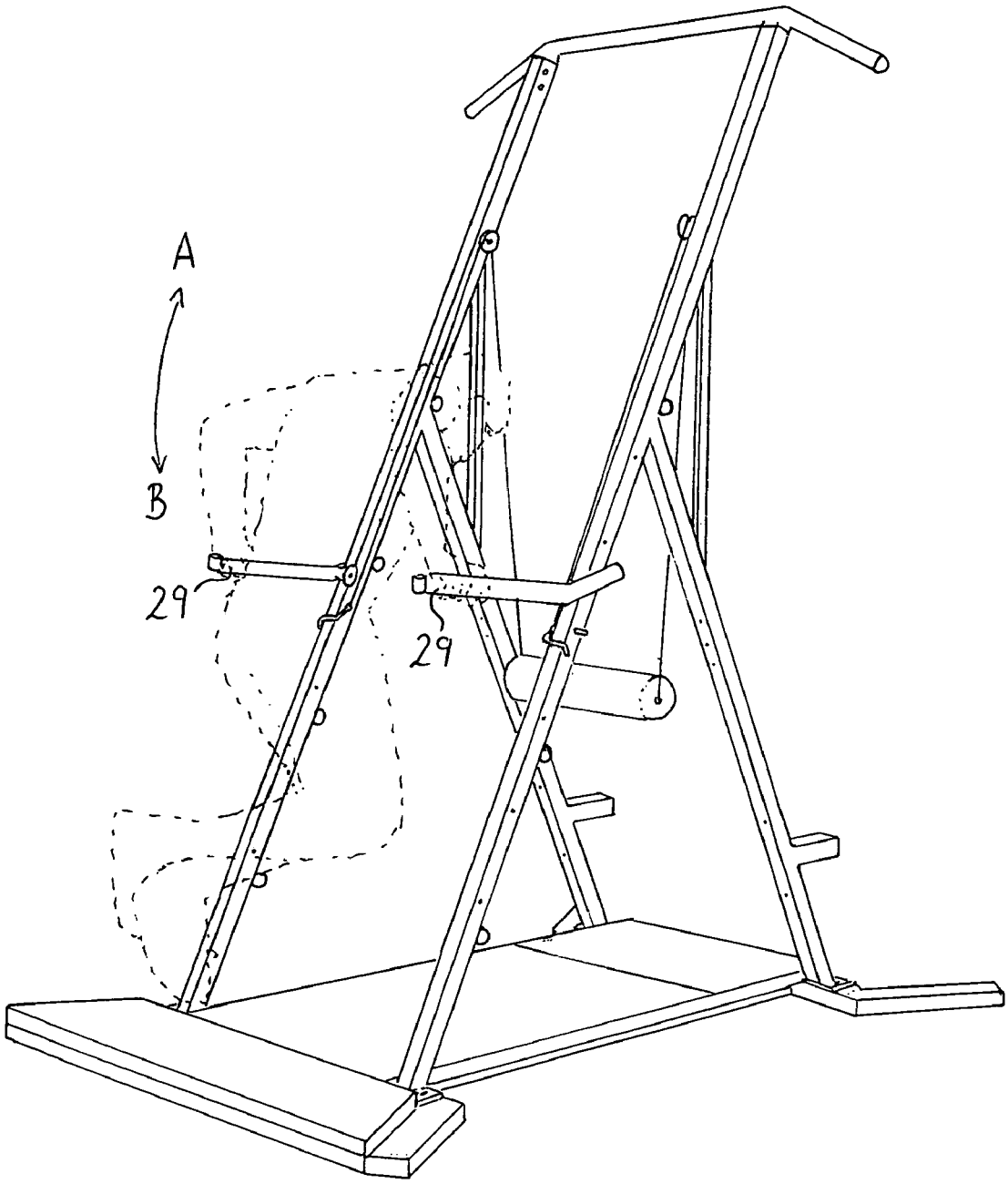
Figure 3G:
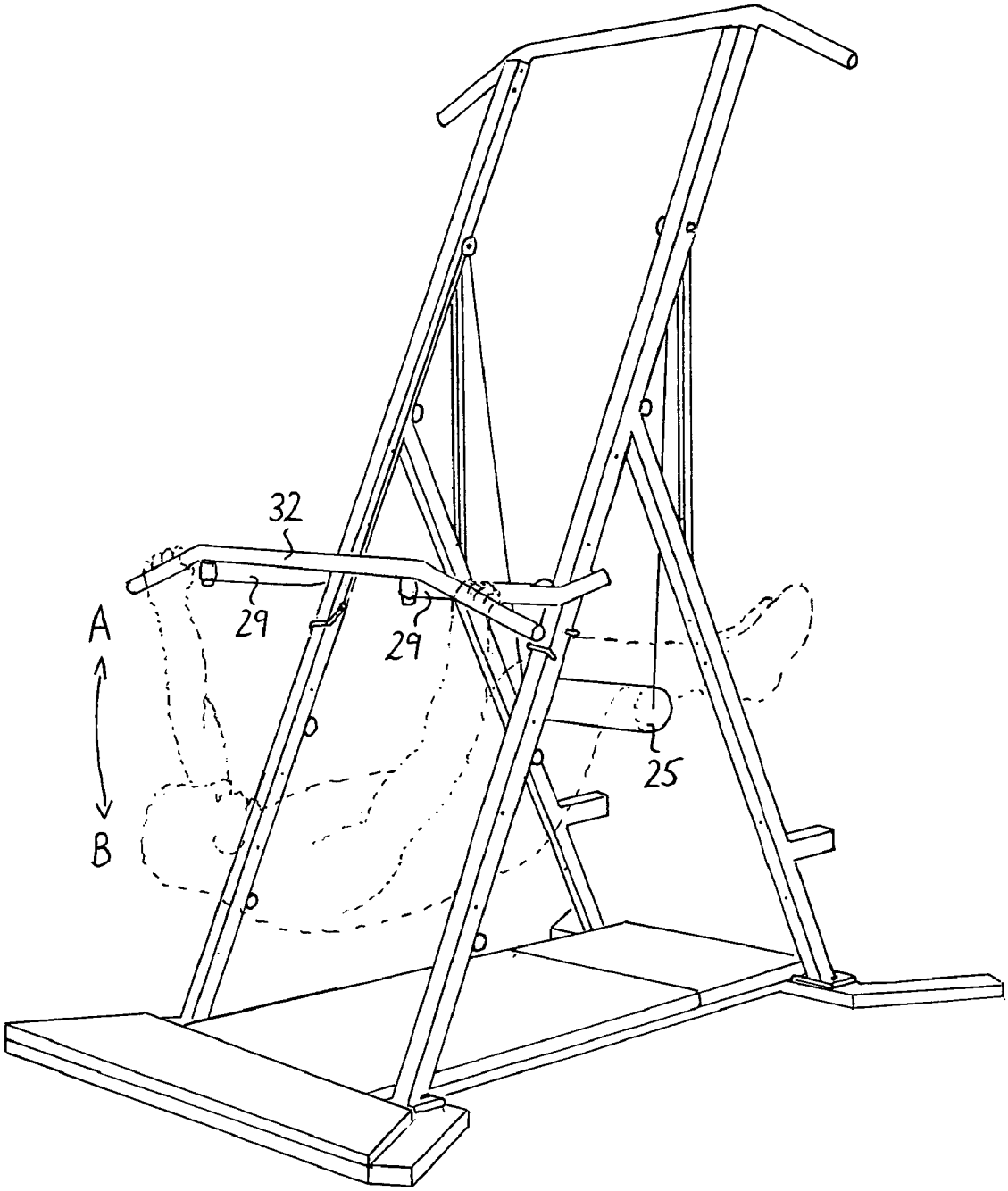
Figure 3H:
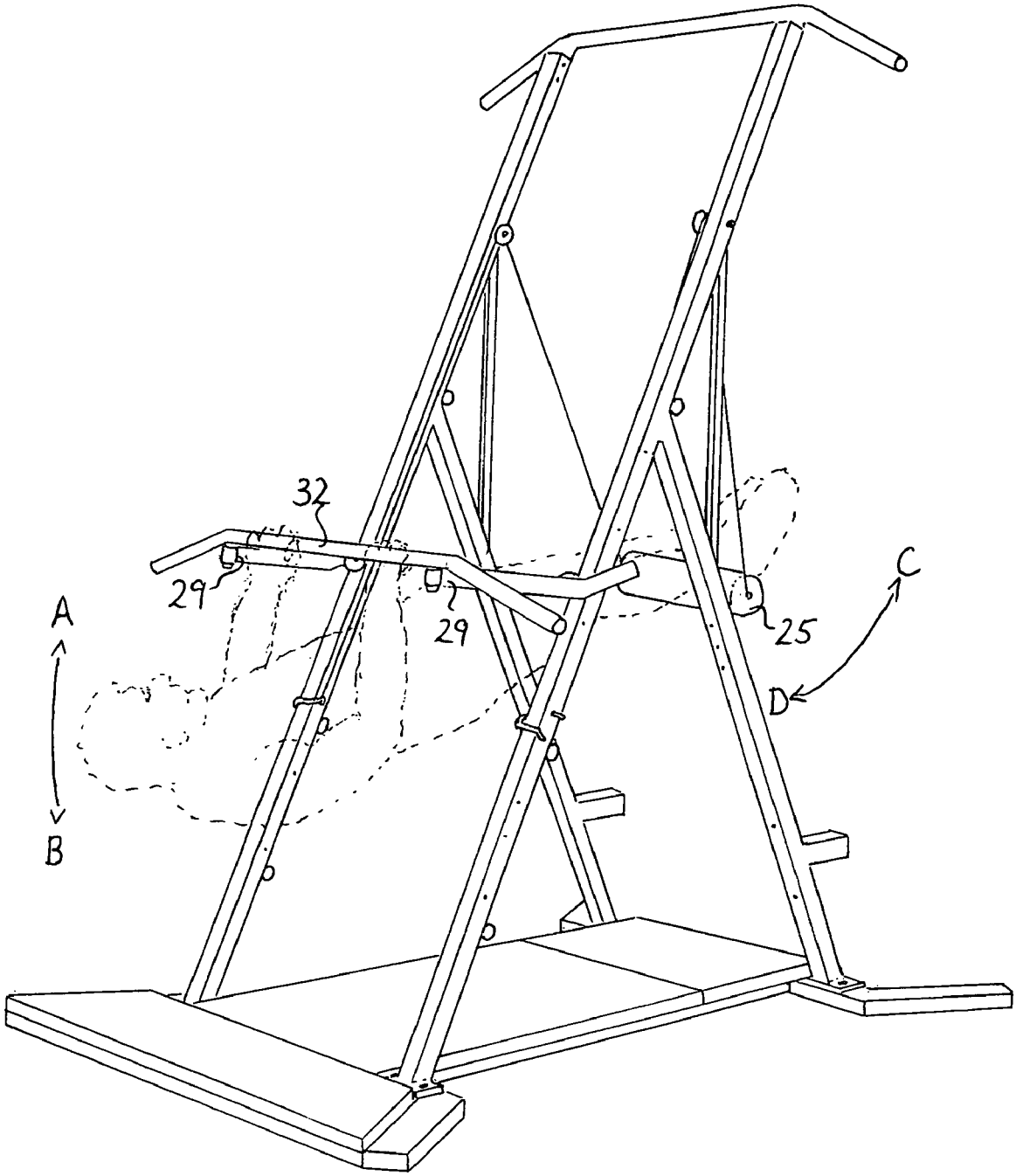
Figure 3I:
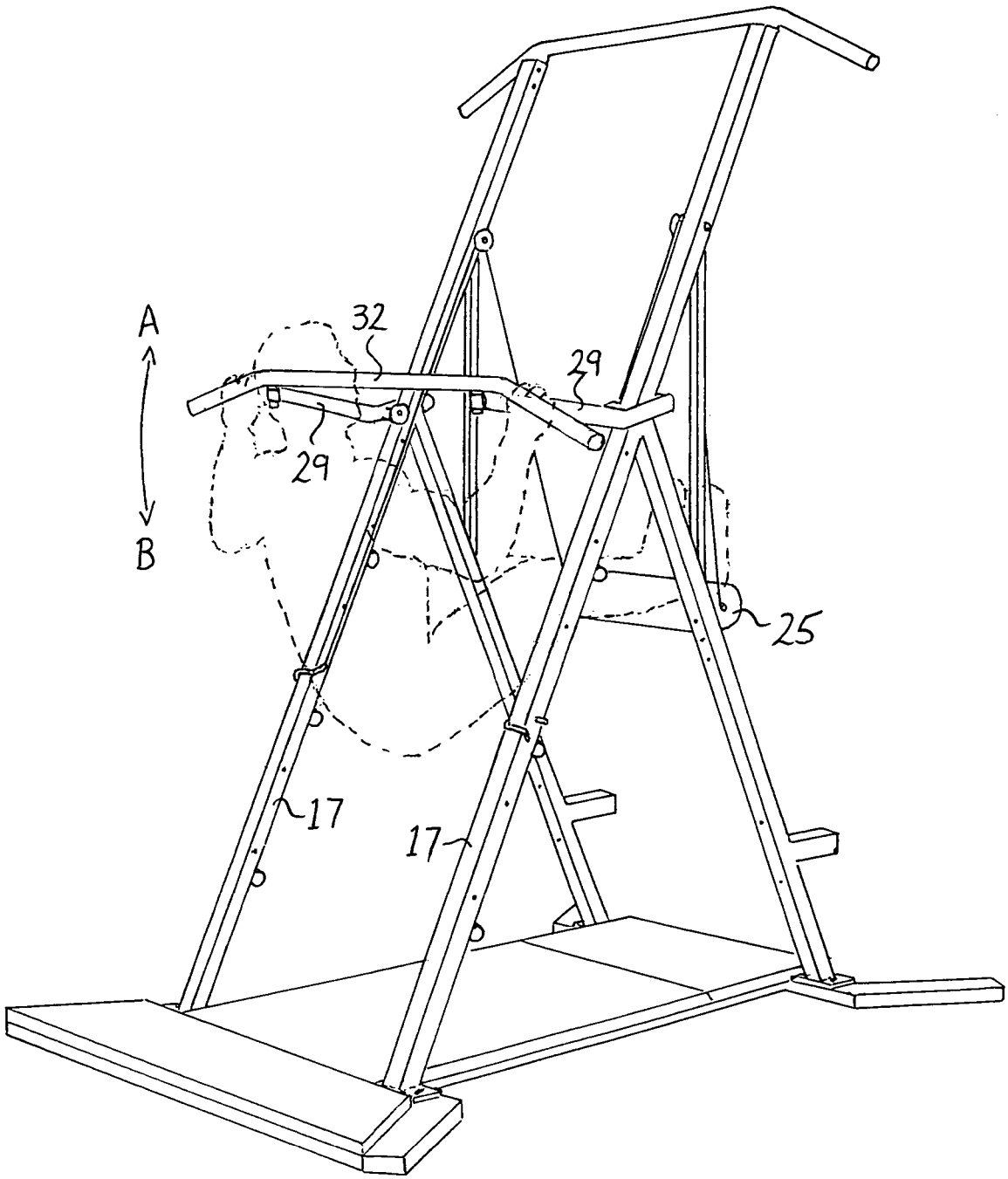
Figure 3J:
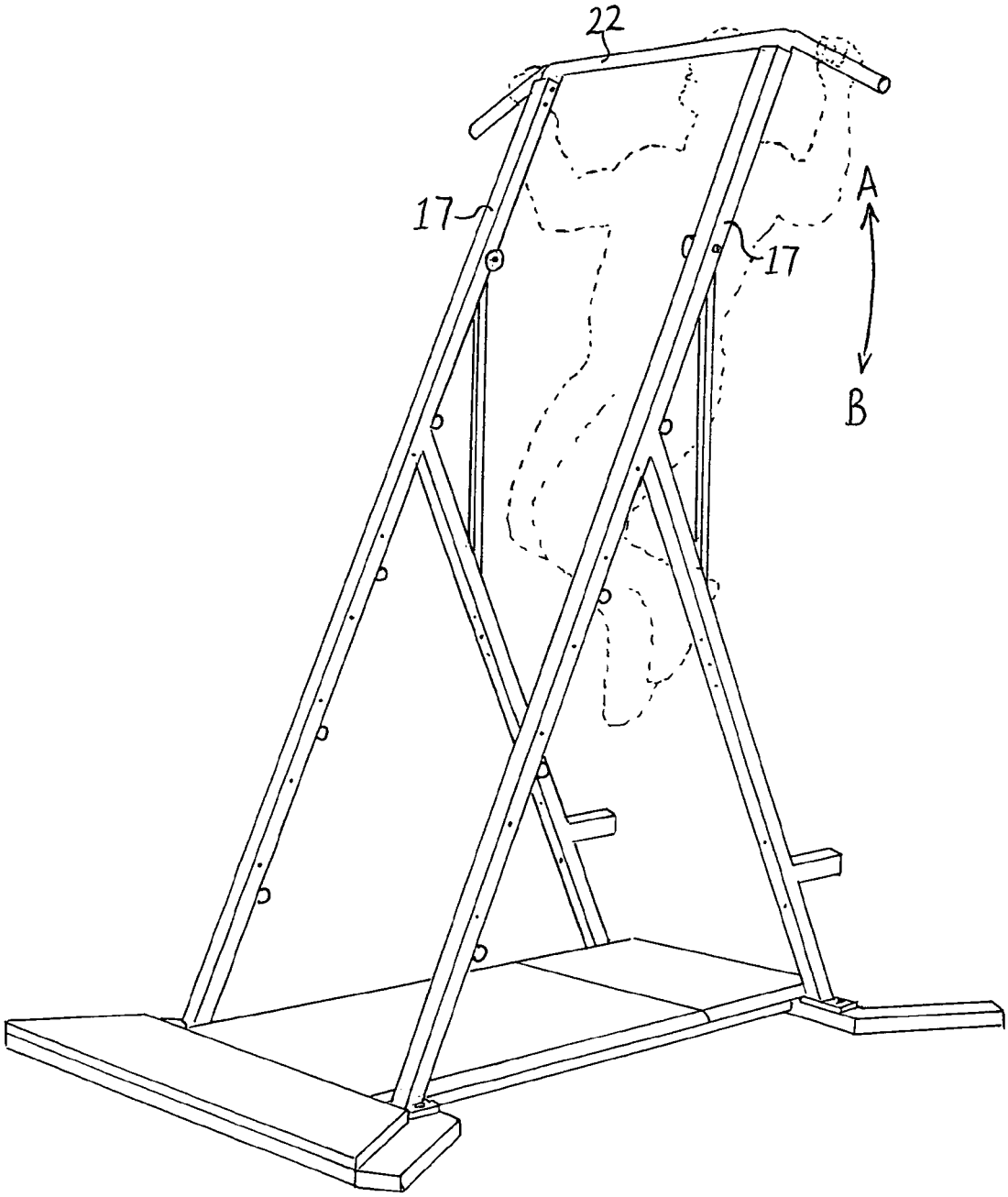
Figure 3K:
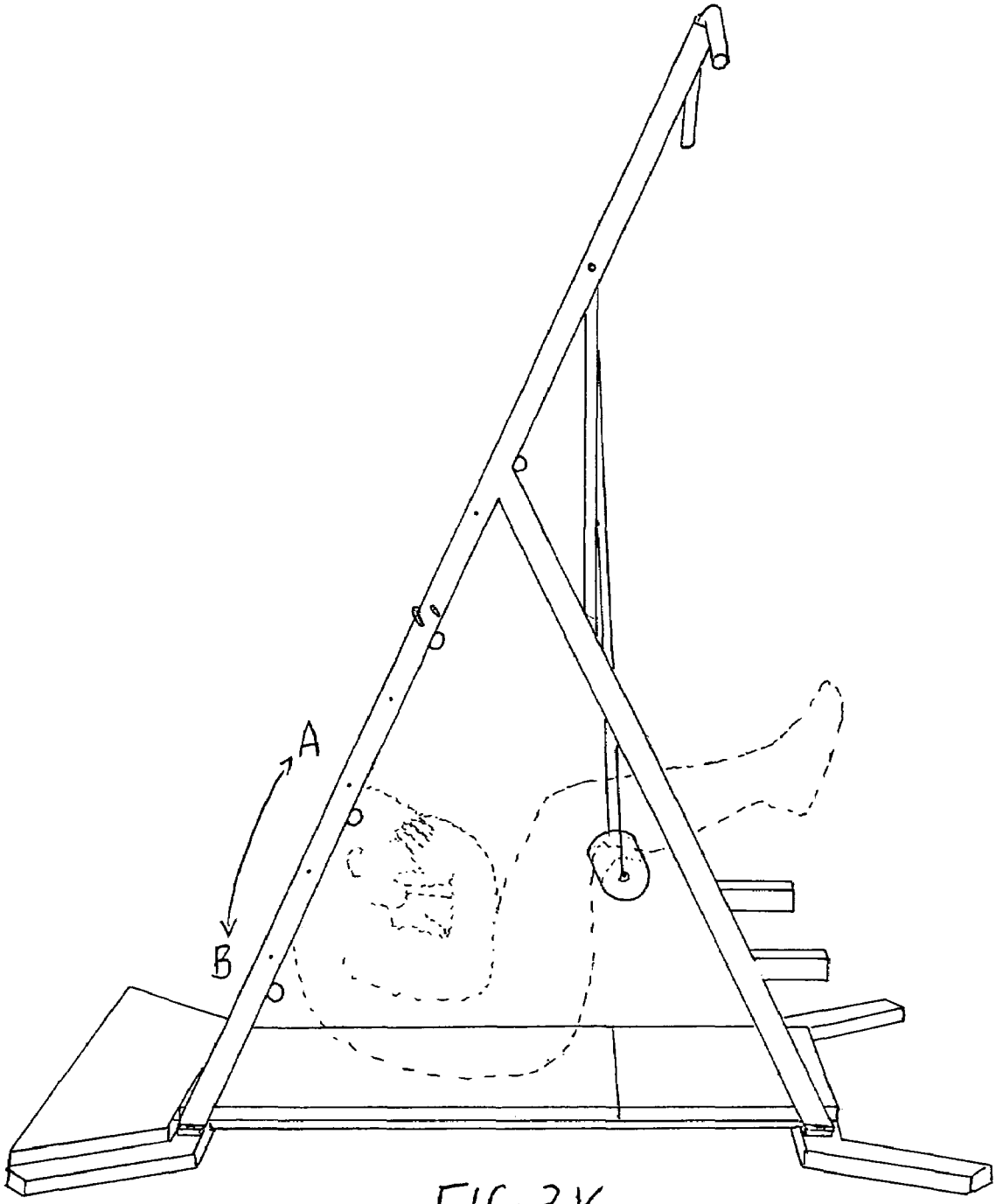
Figure 3L:
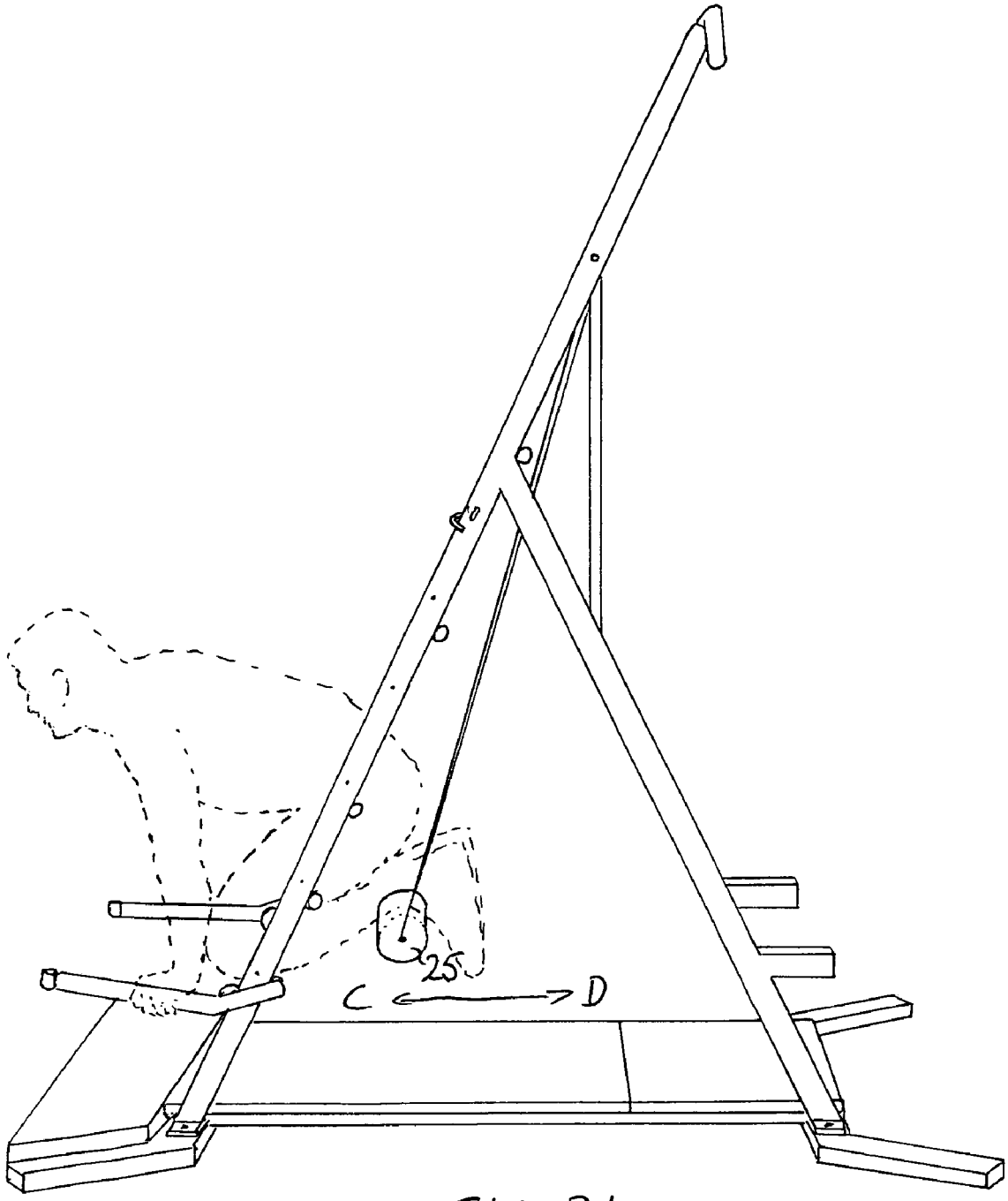
Figure 3M:
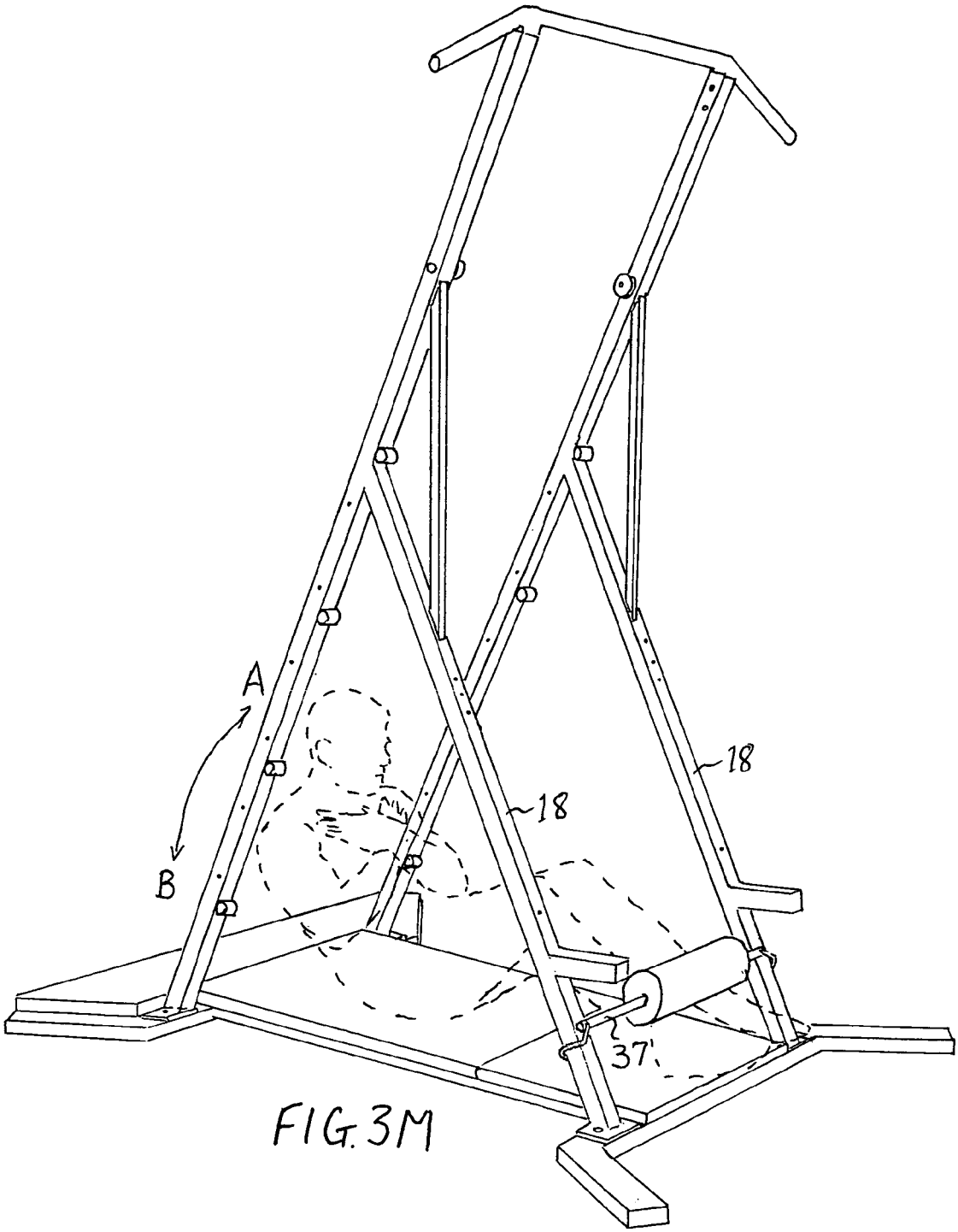
Figure 3N:
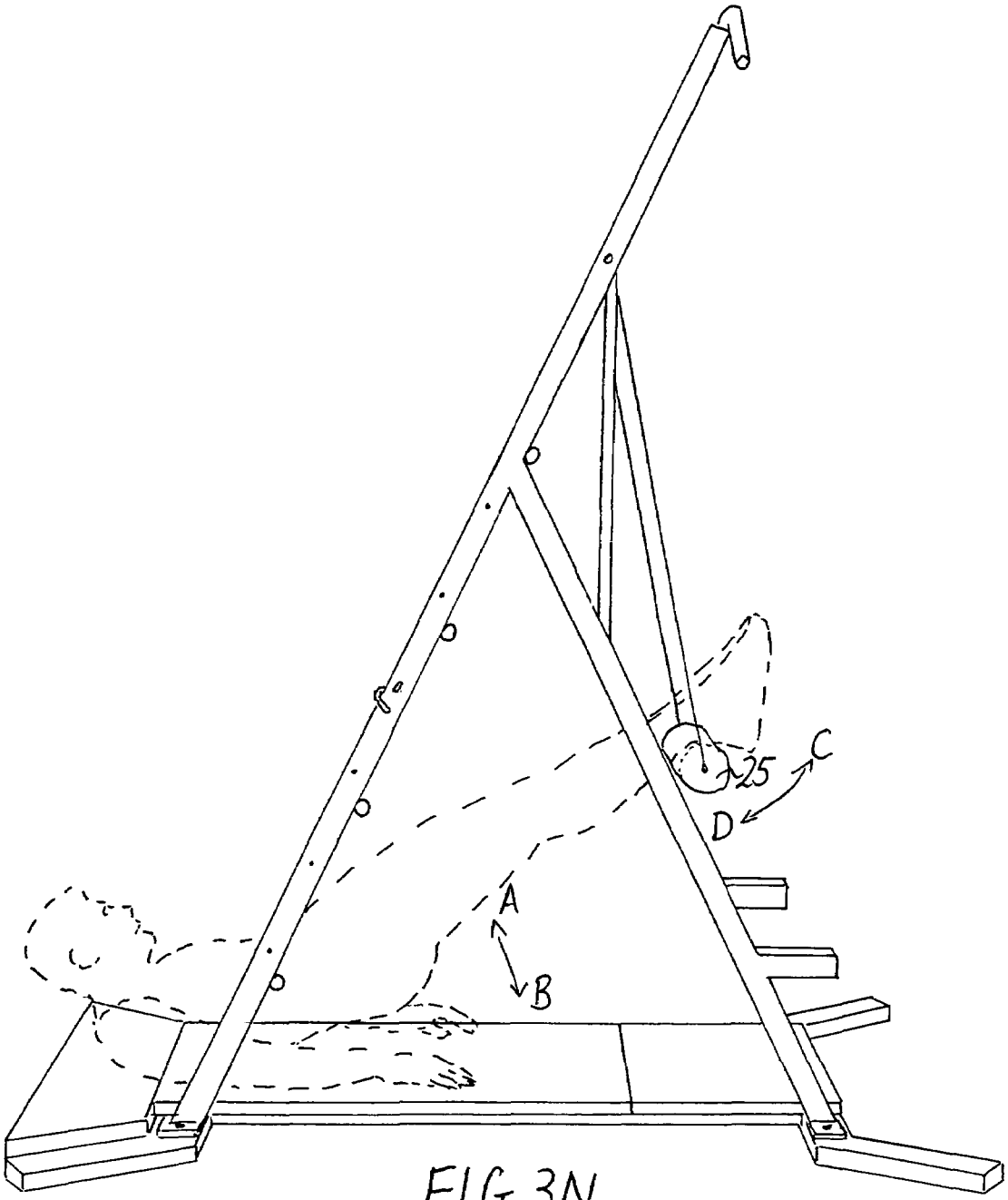
Figure 30:
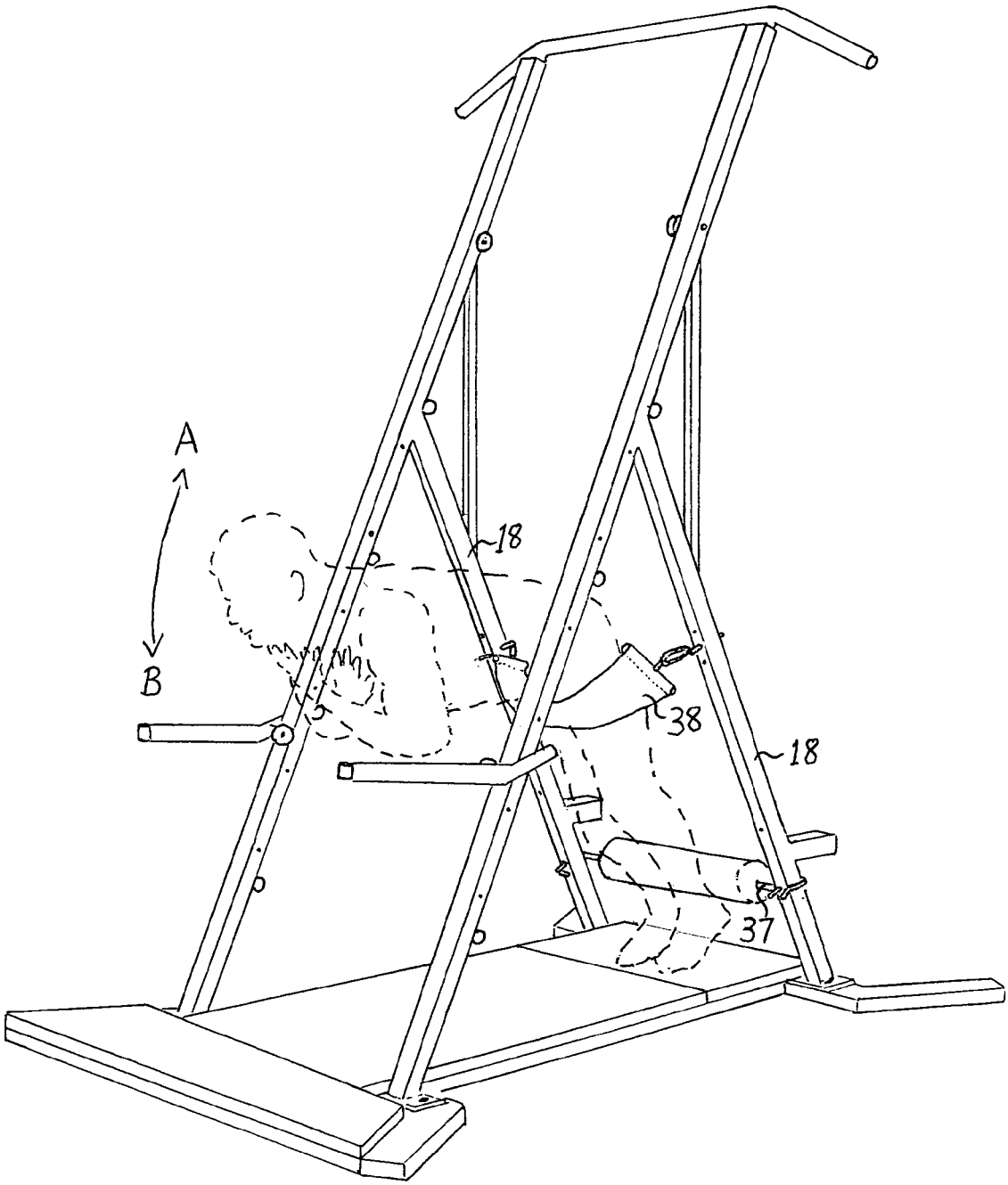
Figure 3P:
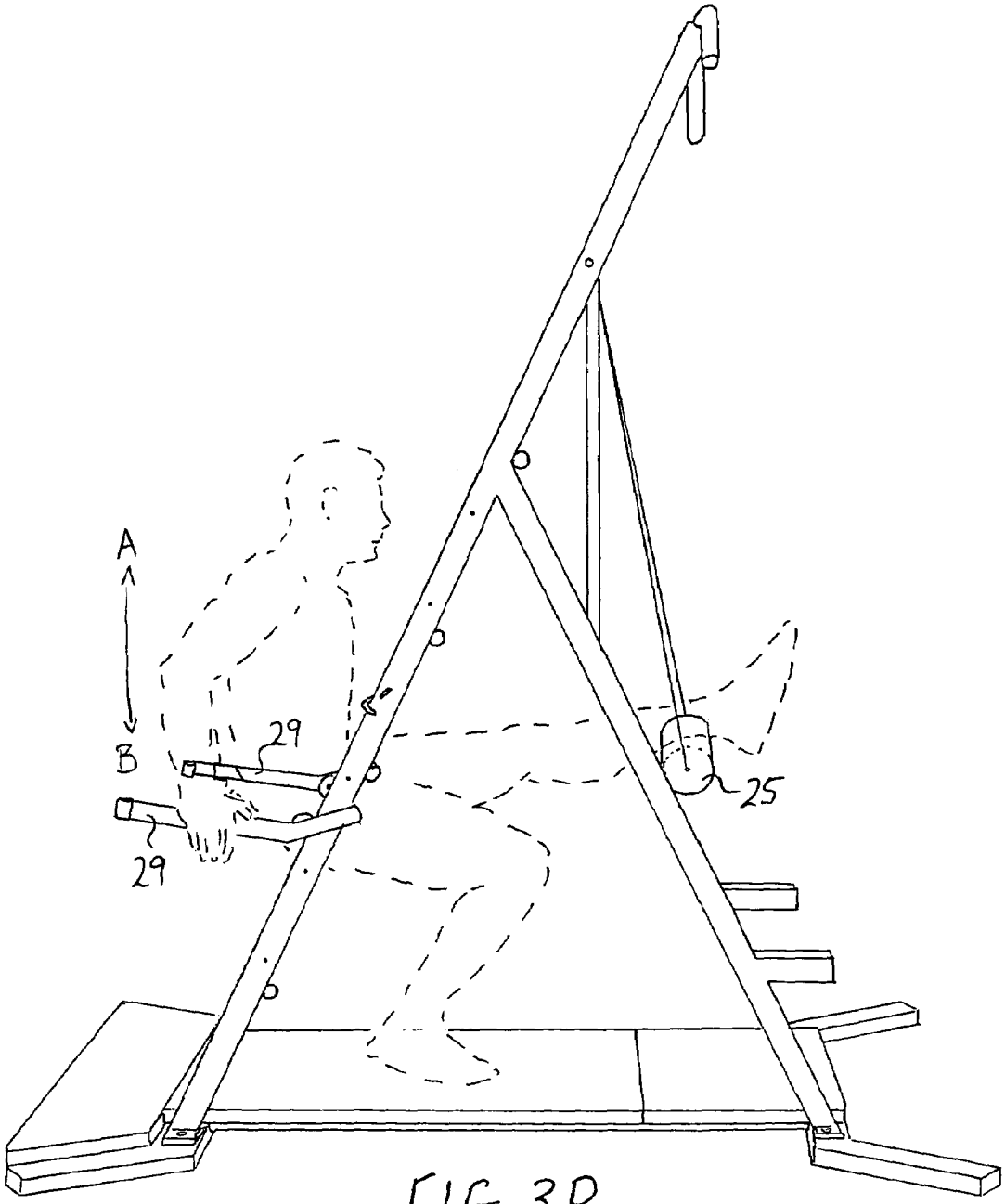
Figure 3Q:
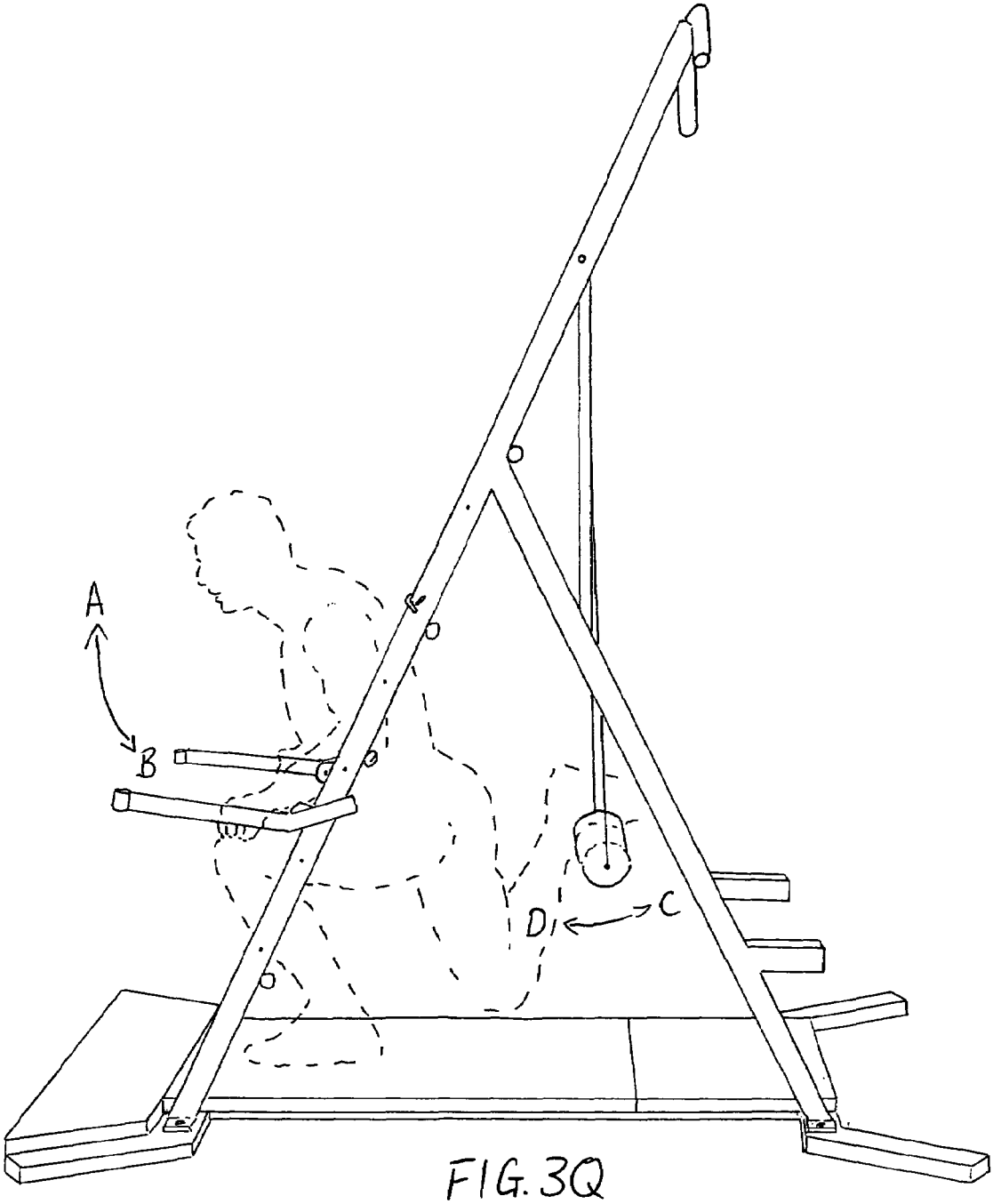
Figure 4:
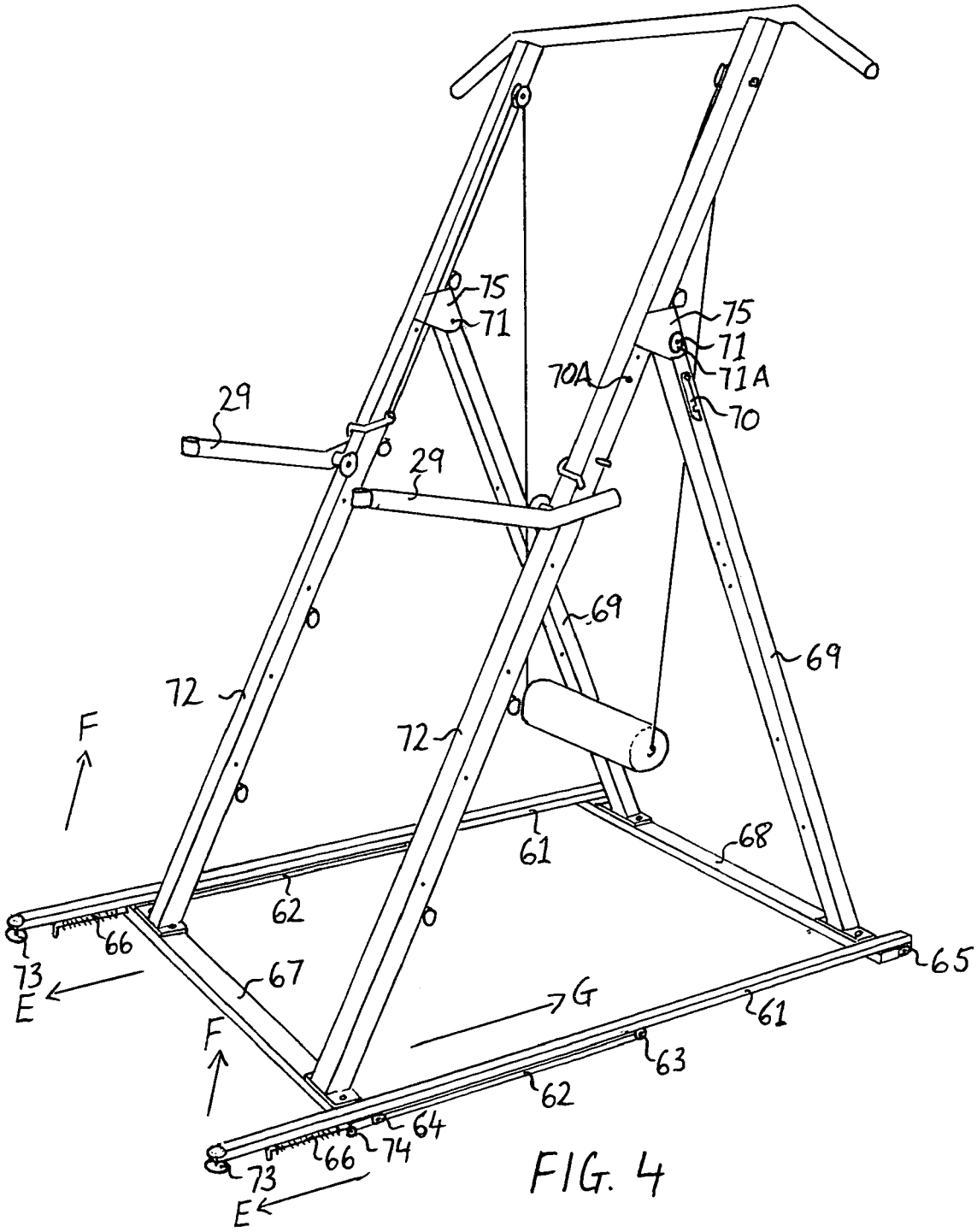
Figure 5B:
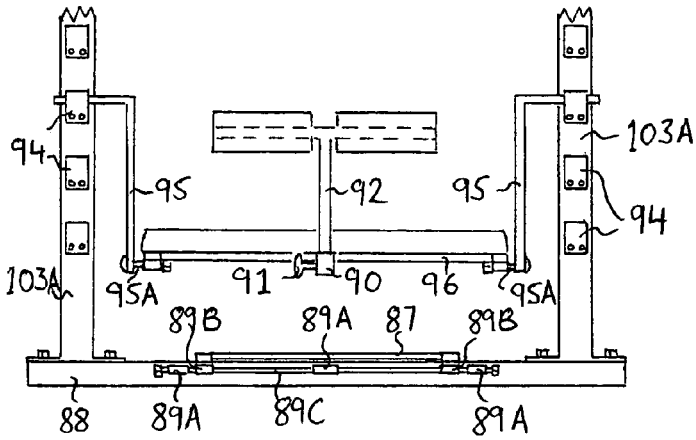
Figure 5A:
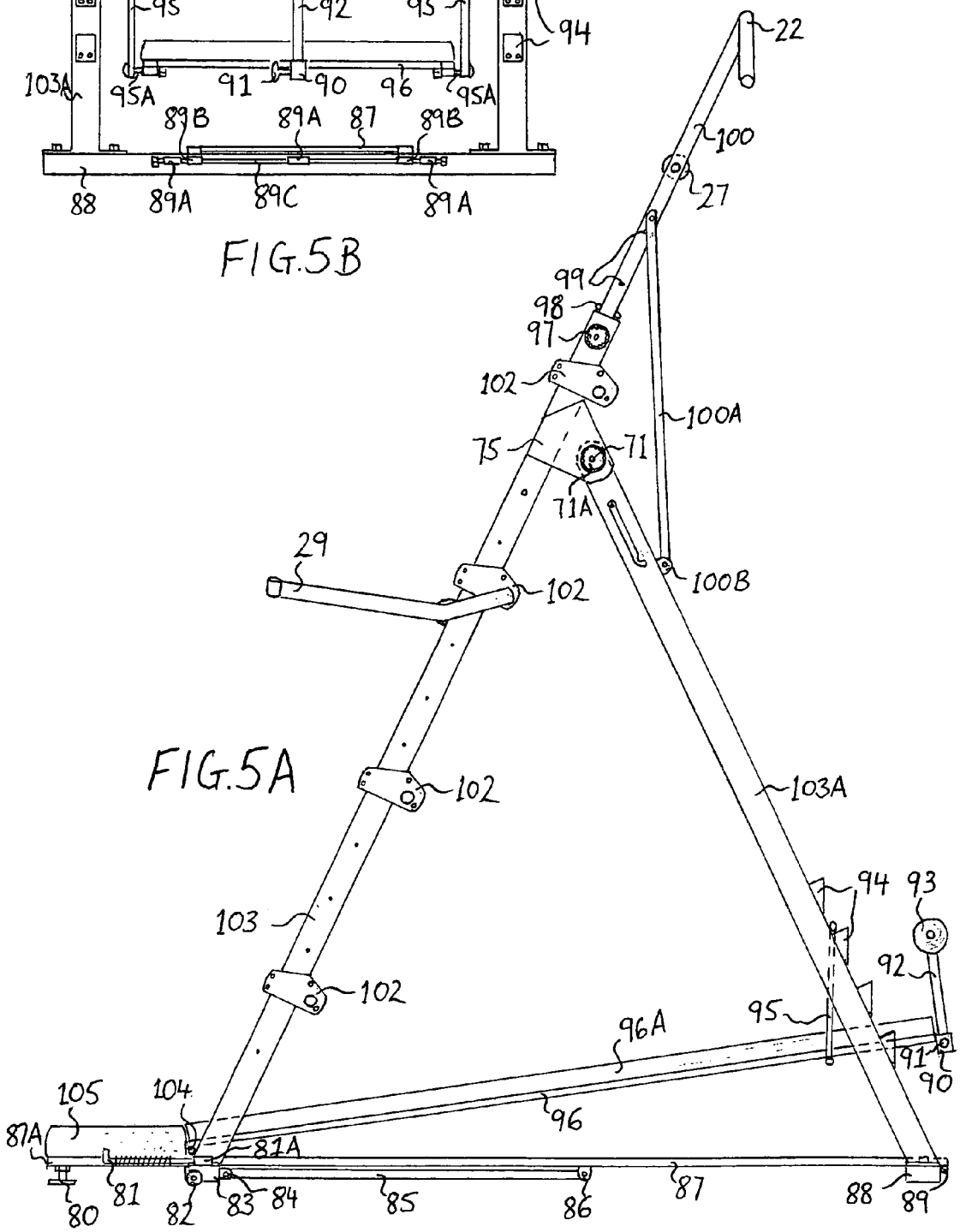
Figure 5C:
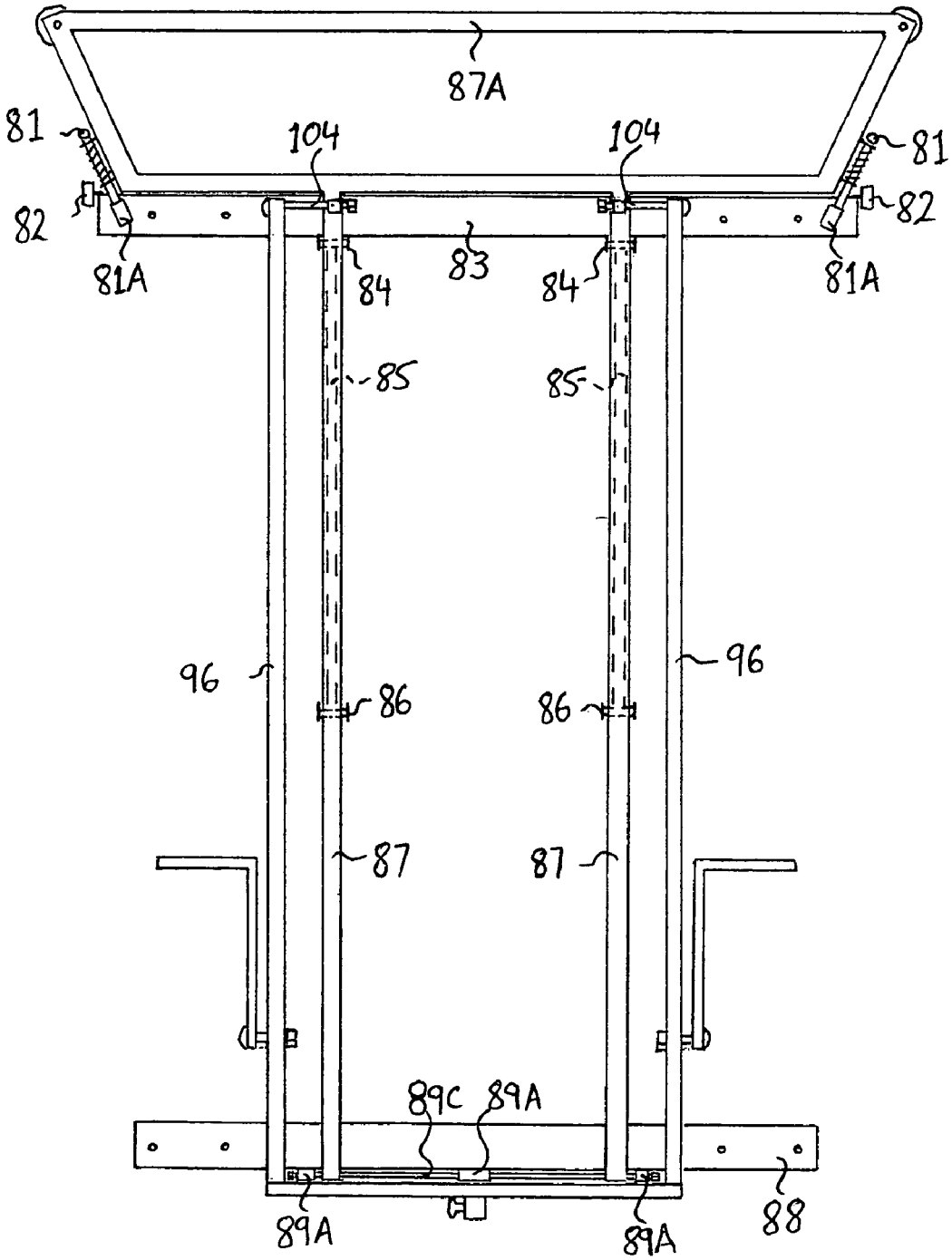
Figure 5D:
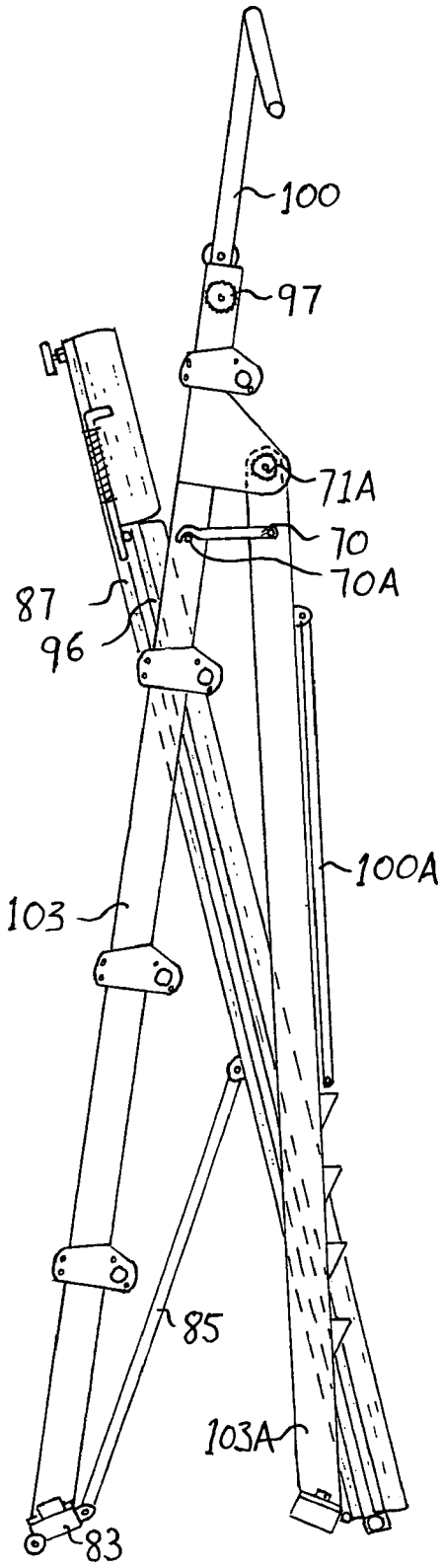
Figure 6A:
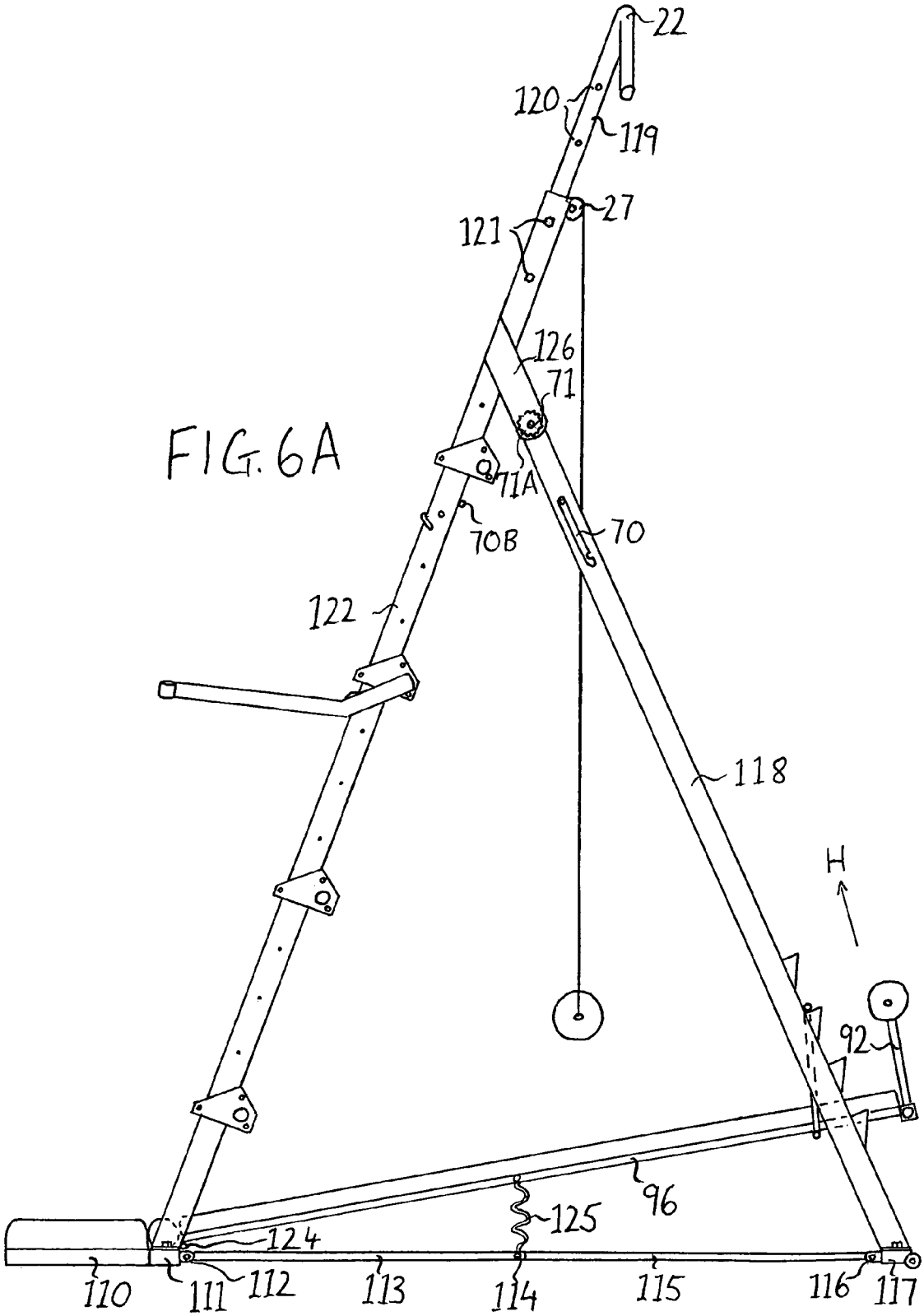
Figure 6B:
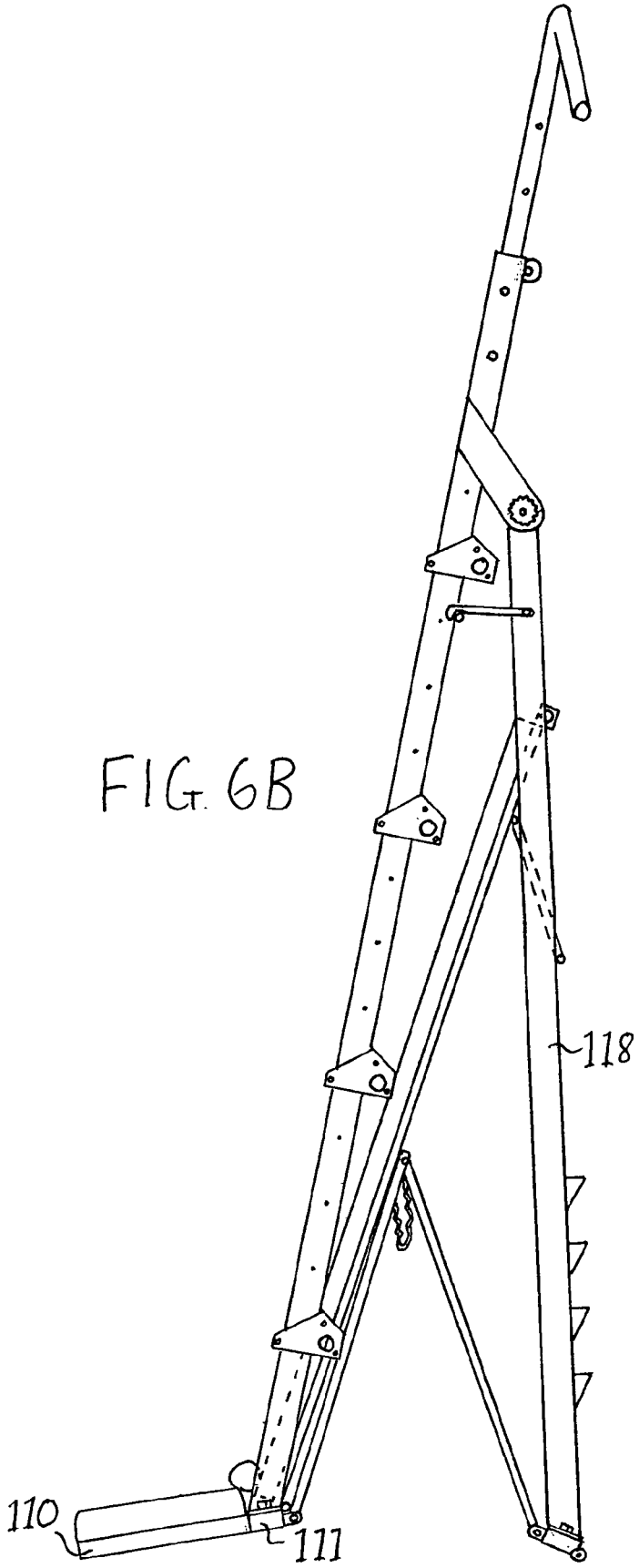

FIGS. 3A to 3Q show the apparatus of FIG. 1 configured and used for various exercises FIG. 4 is a perspective view of an alternative folding embodiment of the apparatus FIG. 5A is a side elevational view of the frame of an additional folding embodiment of the apparatus, additionally incorporating an inclinable sit-up board FIG. 5B is a rear elevational view of part of the frame shown in FIG. 5A FIG. 5C is a top plan view of part of the folding assembly of the frame shown in FIG. 5A FIG. 5D is a side elevational view of the frame of the embodiment of FIG. 5A in a folded state FIG. 6A is a side elevational view of the frame of a further folding embodiment of the apparatus incorporating an inclinable sit-up board FIG. 6B is a side elevational view of the frame of the embodiment of FIG. 6A in a folded state

DETAILED DESCRIPTION—PREFERRED EMBODIMENT

A preferred embodiment of the present invention, particularly suitable for commercial use due to its robust construction, is illustrated in Fig 1 (perspective view). A base frame 11 comprises elongate cross members 13, 13A. Cross members 13, 13A provide means by which a pair of side frames 21 may be horizontally spaced apart in a secure, substantially upstanding, opposed arrangement to each other. The distance between side frames 21 is sufficient for a user to perform exercises between them. And because of this arrangement beneficially a user may move through the opening between the side frames.

Cross member 13 has elongate stabilising extensions 12 that extend laterally forwards and outwards in a substantially horizontal plane and partially or totally in contact with the support surface. Extensions 12 prevent the apparatus from tipping forwards or sideways when the apparatus is in use. A cross strut 14 is connected by welds between forward portions of extensions 12.

Cross member 13A has elongate stabilising extensions 12A that extend laterally rearwards and outwards in a substantially horizontal plane and partially or totally in contact with the support surface to give additional stability to the apparatus. In addition extensions 12A conveniently demarcate an area to the rear of the apparatus to ensure sufficient space is allowed for exercises.

Elongate struts 15 extend between cross members 13, 13A. Struts 15 prevent cross members 13, 13A moving apart due to forces exerted on and by side frames 21 when the apparatus is in use. Struts 15 thereby contribute to the rigidity and stability of base frame 11.

The structural components of base frame 11 are made of sufficiently strong material, such as 60×30 mm rectangular hollow section steel, to withstand the stresses and safety demands of use for exercise. Thus cross members 13, 13A, stabilising extensions 12, 12A and struts 15 of base frame 11 form a rigid and stable base for side frames 21. Base frame 11 may be provided with padding, such as for example rubber feet, at selected points in contact with the support surface to prevent damage. Height adjustable feet of the type commonly used on furniture may also be preferable at various locations on base frame 11 to ensure the stability of the apparatus on an uneven surface.

A rigid board 35, made of for example plywood, and upholstered with a foam mattress (similar to commercial gymnasium mats) or foamed moulding is placed on the front of base frame 11 and supported by cross strut 14, cross member 13, and stabilising extensions 12. A further rigid board 36 is upholstered with a foam mattress or foam moulding on approximately the front two thirds of its length, and a rubber anti-slip surface 36B on the rear one third. Board 36 is supported by cross members 13, 13A and struts 15 of base frame 11. Boards 35, 36 are secured in place by rubber feet 36C screwed to their bases, slotting into the corners formed by the relevant struts. Thus boards 35, 36 provide a level and comfortable area on the apparatus for the user to rest or exercise.

Side frames 21 comprise elongate struts 17, 18 and 19. Struts 17 are forwardly positioned and inclined rearwards. A pair of rigid elongate handles 29 is demountably attached to struts 17. An elongate cushioned member for supporting a user's lower body 25 is suspended via pulleys 27 from upper portions of struts 17. The inclination of struts 17 is sufficient to fulfill two purposes. Firstly, in combination with the forward projecting lengths of handles 29 the incline allows a user to perform exercises without interference from struts 17 by ensuring the user's elbows can remain clear of the apparatus (when performing push ups for example). Secondly the incline of the struts 17 allows lower body support 25 to be suspended from an upper portion of struts 17 at a convenient distance from handles 29 for various exercises. Beneficially, because of the incline, the horizontal distance between handles 29 and lower body support 25 decreases as handles 29 are moved higher up struts 17. This arrangement is particularly convenient for such exercises as assisted chin ups. In this embodiment an inclination of approximately 65° to the horizontal is preferred. In other embodiments an angle in the region of 55° to 80° to the horizontal for struts 17 or their equivalents may conceivably be suitable.

Struts 17 are of sufficient length such that in combination with their angles to the horizontal they allow a cross member or bar for chin up exercises 22 to be located at a position normally above the head of a standing person of average height, and located over rubber matted area 36B of board 36. In this embodiment a length of between 2.3 and 2.6 meters is preferred. Due to the cantilevered arrangement of the upper portions of struts 17 chin up bar 22 is conveniently positioned for chin up exercises to be performed unimpeded by side frames 21.

Struts 18 are inclined forwards at an angle of approximately 65° to the horizonal. Struts 18 are approximately 1.5 meters in length. Struts 18 are welded at an approximately upper middle portion of struts 17. Thus struts 18 provide support for struts 17.

Struts 19 are welded between struts 18 and struts 17 to give extra support and strength to the cantilevered arrangement of the upper portions of struts 17. Steps 20 are welded to struts 18 at a lower portion to assist users in accessing chin up bar 22.

The structural components of side frames 21 are made of sufficiently strong material, such as 50 mm square hollow section steel, to withstand the stresses and safety demands of use for exercise. The configuration of struts 17, 18 and 19 of side frames 21 contribute to forming a strong and secure support for a user.

Side frames 21 are connected to base frame 11 via rectangular steel-plate feet 16 (with bolt holes) welded on the bases of struts 17, 18 and bolts engaging threaded holes in, or nuts welded in, the top surface of cross members 13, 13A. Reinforcing plates (not shown) are welded to the top surface of cross members 13, 13A where feet 16 of side frames 21 are connected, in order to reduce flexing in the surface of the cross members. When connected in this manner to base frame 11 side frames 21 are spaced apart in a substantially mirror image arrangement to each other and substantially vertically. The distance between side frames 21 is a balance between providing sufficient space to exercise while also allowing handles 29 to be spaced apart at a distance to suit the majority of users. A horizontal distance of between 60 and 80 centimeters is most likely to suit a majority of users, whilst in this embodiment a distance of approximately 68 centimeters is preferred.

Handles 29 are elongate and project substantially forwards from struts 17 in a symmetrical arrangement to each other and sufficiently horizontally or levelly disposed so a user may hold the handles from above. The parts of handles 29 that a user holds during exercise project sufficiently forward of struts 17 to permit users to exercise unimpeded by struts 17. A projection of between approximately 20 to 40 centimeters from the forward face of struts 17 is most likely to suit a majority of users. In this embodiment a distance of approximately 30 to 35 centimeters from the forward faces of struts 17 to the ends of handles 29 is preferable. Further description of handles 29 is given in FIGS. 2A and 2B.

In this embodiment handles 29 are adjustable between and securable at four pre-determined fixing or mounting positions on struts 17 by the provision of tubular steel sleeves 33A, 33B, 33C, 33D.

These sleeves are welded to the rear faces of struts 17 in a substantially horizontal orientation for lugs on handles 29 to mate with. Alternatively the sleeves may be welded to plates, and the plates subsequently bolted to the rear face of struts 17 using threaded holes or the like to avoid the risk of distortion caused by welding directly to the struts. The heights of handles 29 above the top surface of boards 35, 36 in each position is a balance between being sufficiently high to allow a range of movement in the appropriate exercises by users of differing sizes and physiques, while sufficiently low to promote a feeling of safety.

Embodiments when set up for use comprise means to secure the handles 29 in a plurality of positions such that the parts of the handles that are held during exercise may be vertically spaced from the top of any exercising surface by;

a) at least 10 centimeters and may be used for push ups and decline push ups
b) at least 20 centimeters and may be used for assisted dips
c) at least 40 centimeters and may be used for incline push ups
d) at least 60 centimeters and may be used for bodyweight rows
e) at least 80 centimeters and may be used for dips
f) at least 100 centimeters and may be used for assisted chin ups.

Any level exercising surface includes boards 35, 36 of FIG. 1, other boards or cushioning provided or used with other embodiments, or the floor where no cushioning is provided.

Therefore, given the imperative to keep any exercising positions as low to the exercising surface as possible and still allow a full range of movement, at least three positions for any handle means are preferred. Thus in embodiments with three positions for handles 29, the lowest position for the handles would be used primarily for any of the following; push ups, decline push ups, and assisted dips; the middle position would be used primarily for bodyweight rows, incline push ups and potentially for assisted dips; and the highest position would preferably be used primarily for assisted chin ups, dips and potentially for bodyweight rows.

In the embodiment shown in FIG. 1 sleeves 33A allow the part of the handles 29 that are held during exercises to be positioned approximately 20 centimeters above the top surface level of boards 35, 36 for push ups and decline push ups. Sleeves 33B allow same to be positioned approximately 55 centimeters above the level of boards 35, 36 for incline press ups and assisted dips. Sleeves 33C allow same to be positioned approximately 90 centimeters above the level of boards 35, 36 for dips and bodyweight rows. Sleeves 33D allow same to be positioned approximately 125 centimeters the level of boards 35, 36 for assisted chin ups and dips. These positions are further illustrated in FIGS. 3A to 3Q.

An elongate rigid member or bar 32 has lugs 32A welded on it that slot into short tubular steel sleeves 30 welded at end portions of handles 29. Bar 32 is made of suitably strong material, such as tubular steel, to support the weight of a user. Bar 32 provides variation in certain exercises when required.

Chin up bar 22 is bridgingly connected between upper portions of side frames 21. Chin up bar 22 has two main purposes. Firstly to support a user in performing chin ups and secondly through its connections to side frames 21 to contribute to the overall structural stability of the apparatus. Chin up bar 22 is made of suitably strong material, such as tubular steel, to support the weight of a user. Elongate projections 22A are welded on chin up bar 22 and have threaded nuts recessed and welded on their inner faces. Projections 22A are sleeved inside and bolted 24 to upper portions of struts 17. Chin up bar 22 has angled extensions 23 that extend outwards and downwards to allow exercises such as wide arm pull ups to be performed.

Lower body support 25 comprises a rigid tube padded with a foam cushion roller for the comfort of the user. The tube is of a sufficiently strong material, such as steel or aluminium, to support the weight of a person in a safe manner. The overall length of lower body support 25 is less than the distance between side frames 21 to allow lower body support 25 to swing freely when in use. The tube of lower body support 25 has eyes welded at end portions to allow cords 26 to be attached.

Lower body support 25 is suspended substantially horizontally and oriented across the space between side frames 21 by slender elongate flexible structures such as elongate cords 26. Cords 26 allow lower body support 25 to swing freely (pendulously), on impulse from a user, in the space between pair of side frames 21. Cords 26 pass over pulleys 27 and are routed to securing positions on struts 17. Pulleys 27 are rotatably mounted on bolts 27A and connected through holes in an upper portion of struts 17. Pulleys 27 have a steep sided groove to help prevent cords 26 from disengaging during any exercise or adjustment. Pulleys 27 are positioned at an upper portion of struts 17 such that lower body support 25 is suspended approximately 80 centimeters in a horizontal direction along the apparatus from the rear face of cross member 13 or from the bases of struts 17. This distance is a balance between ensuring sufficient horizontal separation of lower body support 25 from handles 29 in any of positions 33A to 33C in order to allow control by a user in the different exercises, while being sufficiently close to those positions to be easily accessible. In alternative embodiments a distance of between 50 and 10 centimeters may be conceivable, though a distance of between 60 and 90 centimeters would be preferable for a majority of users.

Cords 26 are of a sufficiently strong material, such as nylon rope, to support the weight of a person in a safe manner when exercising. Cords 26 pass over pulleys 27 and are attached to eyes on bent locking pins 28 (of the type commonly found on weight benches and the like). Pins 28 engage apertures 34 spaced along part of the length of struts 17 and drilled through the inward and outward facing sides. Apertures 34 are located in positions sufficiently above and below the level of sleeves 33A, 33B, 33C, 33D to avoid pins 28 interfering with handles 29 during removal and insertion or vice versa. Apertures 34 are spaced over approximately 1 meter to allow the lower body support 25 a range of vertical adjustment of the same distance. This range of movement is sufficient to provide a majority of users with a sufficient choice of configuration for exercises.

A rigid tube 37, of material such as steel or aluminium, and strong enough to support the weight of a person exercising is partly covered with a foam cushion roller 37B. Tube 37 is of the correct length to be releasably connected between struts 18 via bent locking pins 37A engaging apertures 37C drilled through struts 18 from the rear, and located above and below steps 20.

A flexible strap 38 is long enough to readily extend between struts 18 and wide enough to support a person with comfort. Strap 38 is sewn around two short steel tubes 38A. Tubes 38A have eyes welded on them to allow connection via suitable means such as clips or karabiners to eyes welded on pins 38B. Strap 38, tubes 38A, pins 38B and clips are strong enough to support the weight of a person exercising. When required for use, strap 38 is extended between struts 18 and pins 38B engage a choice of apertures 38C drilled through from the rear and approximately midway up struts 18. The angle of the struts 18 allows strap 38 to be conveniently positioned forward of cushioned tube 37 for lower back extension exercises.

DETAILED DESCRIPTION—HANDLES

Figure 2A:
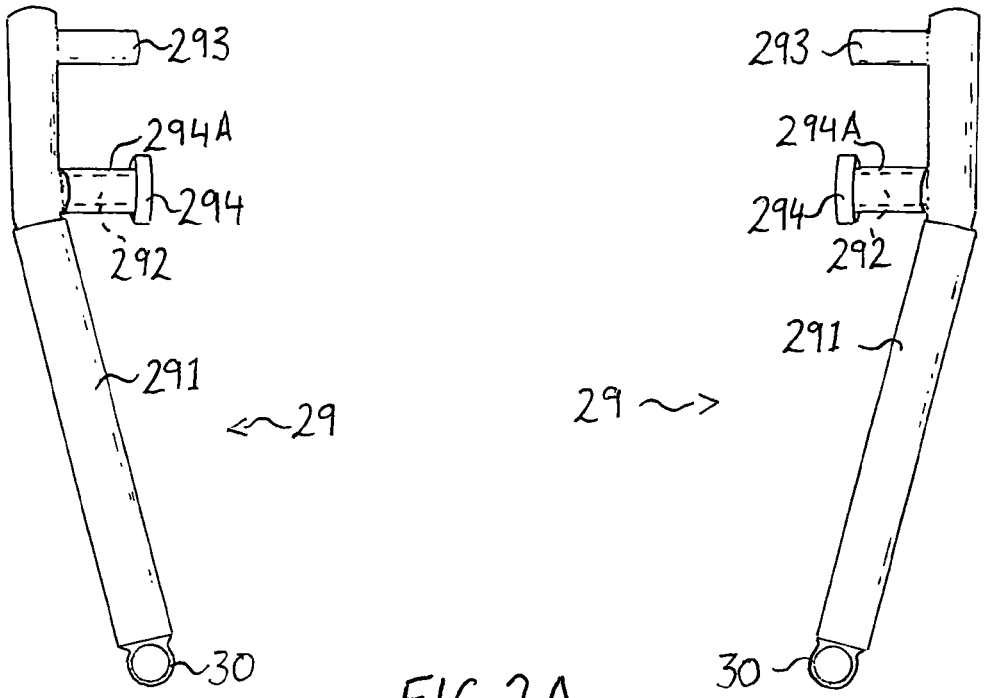
FIGS. 2A and 2B show the handles of the apparatus

Referring to FIG. 2A (top perspective view) there is shown in greater detail the preferred method of constructing handles 29. Handles 29 comprise angled steel tubes 291, either two pieces welded as illustrated or one piece bent. Handles 29 have lugs 292, 293 welded on. Plastic discs 294 and plastic protective coverings 294A are attached via suitable means such as bolts engaging threaded holes in the end of lugs 292. Lugs 293 mate with sleeves 33A, 33B, 33C, 33D welded on the reverse faces of struts 17 of the apparatus illustrated in FIG. 1. Short tubular steel sleeves 30 are welded in a substantially vertical orientation at end portions of angled steel tubes 291, to allow the attachment of the bar 32 of FIG. 1.

Figure 2B:
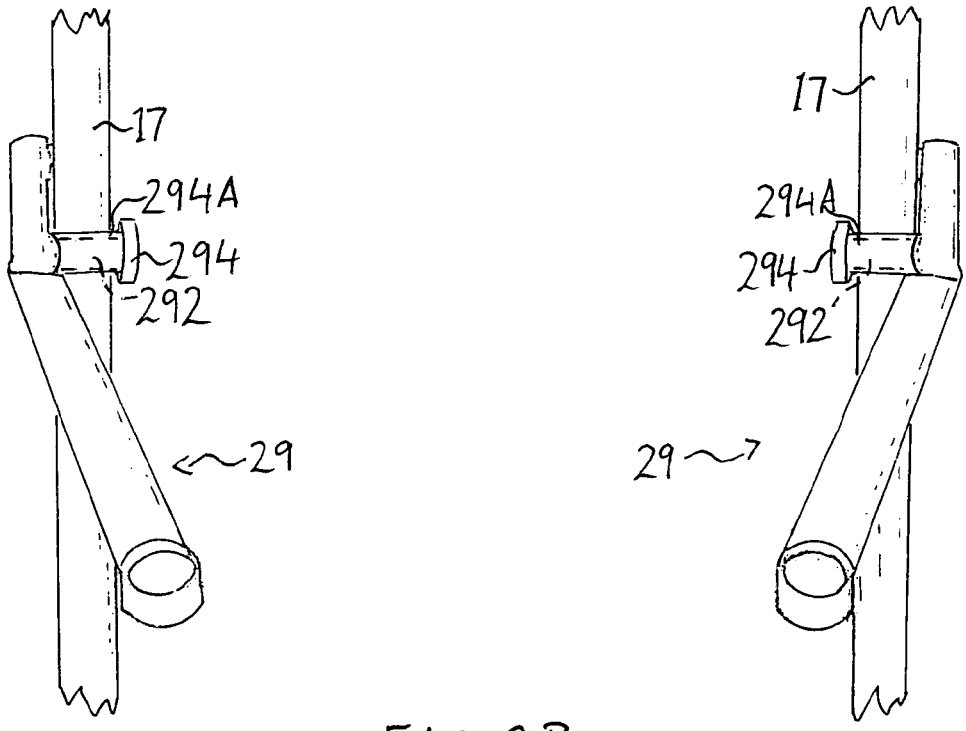

Referring to FIG. 2B (front perspective view) handles 29 are shown mounted on struts 17. Lugs 292 rest on the forward faces of struts 17. Discs 294 prevent handles 29 from sliding out of position when handles 29 are mounted on struts 17. Plastic covering 294A protects any finishing from damage.

Advantageously the converging projecting portions of handles 29 allows users to change the width between their hands, dependent on where handles 29 are held. This feature has four benefits. Firstly it allows easy use by persons of differing physical size with no adjustment to the set up of the apparatus. Secondly it allows users to quickly change the muscular emphasis of exercises by easily changing the width between their hands. Thirdly it provides for the differing grip width required by different exercises. For example press ups are usually performed with hands wider apart than for dips. Fourthly handles 29 may be placed on opposite struts to those illustrated in FIG. 2B (such that plastic discs 294 face outwards) and held close to struts 17 to further narrow the distance between the user's hands if desired. Handles 29 are constructed of suitable materials, such as 32 mm steel tube with a wall thickness of 3 mm, to ensure they are strong enough to support the weight of a user. Handles 29 may be covered with a rubber anti slip grip. When mounted, handles 29 project approximately 30 to 35 cm from the forward faces of struts 17. In combination with the angle of struts 17 this configuration ensures that the user may exercise without conflicting with the frame of the apparatus.

OPERATION OF THE INVENTION—FIG. 1, FIGS. 3A to 3Q

Referring to FIG. 1, in brief, prior to use, handles 29 are mounted in position for the desired exercise, with bar 32 attached to handles 29 if needed. Lower body support 25 is raised to or lowered to, and secured at, the preferred height via cords 26, pulleys 27, pins 28 and apertures 34. Depending on the type of exercise, lower body support 25 provides the user with assistance, a full and fluid range of movement, ability to vary the angle of the body and thus emphasis of exercise, and a workout for the core muscles and stabilising muscles.

FIGS. 3A to 3Q illustrate different applications of the present invention in which a user (shown in dotted lines) is performing some of the range of exercises possible. The movement of the user is indicated by arrows A and B FIG. 3A (perspective view) illustrates the apparatus being used for push up exercises. Handles 29 are mounted in the lowest position. Lower body support 25 is lowered to a position approximately level with handles 29. The user is resting his or her feet on lower body support 25, for maximum difficulty. Alternatively the user may rest his or her thighs, for example, on lower body support 25 thus supporting more of their bodyweight and making the exercise easier. The movement of lower body support 25 is indicated by arrows C, D.

FIG. 3B (side perspective view) illustrates the apparatus being used for decline push up exercises.

To facilitate this exercise lower body support 25 is raised up and secured in one of several possible positions, such that the user's feet may be higher than his or her shoulders. The movement of lower body support 25 is indicated by arrows C, D. This illustration also shows how handles 29 and the angle of struts 17 ensure the user can exercise without interference from the apparatus.

Using the exercise apparatus for push ups and decline push ups in this manner has several advantages; firstly, the raised positions of handles 29 allow the user to lower his or her upper body through a greater range of movement than by placing their hands on the floor. Secondly, as the user moves in the direction of arrow A or B, lower body support 25 moves in the direction of arrow C or D respectively. This movement compensates for the changing distance between the user's hands and feet as the exercise is performed, thus giving a full and fluid range of movement in the exercise.

FIG. 3C (side perspective view) illustrates the apparatus being used for incline push up exercises with handles 29 mounted in the second lowest position. FIGS. 3A, 3B, and 3C illustrate how the apparatus easily allows the user to change the angle of their body and thus the emphasis of exercises on different muscle groups.

FIG. 3D (side perspective view) illustrates the apparatus being used for assisted dip exercises. Handles 29 are mounted in the second lowest position. By resting the ankles on lower body support 25 the user decreases the proportion of bodyweight lifted using the arm and chest muscles, thus assisting himself or herself with the exercise.

FIG. 3E (perspective view) illustrates the apparatus being used for assisted dip exercises using a narrow grip on bar 32 to emphasise use of the triceps.

FIG. 3F (perspective view) illustrates the apparatus being used for dip exercises with handles 29 mounted in the second highest position Thus FIGS. 3D, 3E and 3F illustrate how the apparatus facilitates progressively more difficult bodyweight exercises.

FIG. 3G (perspective view) illustrates the apparatus being used for bodyweight row exercises. Handles 29 are mounted in the second highest position, with bar 32 attached. The user is supporting his or her body by resting the backs of the knees on lower body support 25. By making the knees the pivot point for the body the exercise is easier than when the ankles are placed on lower body support 25. Thus the apparatus allows a user quickly and simply vary the difficulty of exercises by changing their body position.

FIG. 3H (perspective view) illustrates the apparatus being used for decline bodyweight row exercises. By raising the height of lower body support 25, and thus the position of the feet, in relation to handles 29, the user emphasises use of the muscles of the upper back and shoulders. Bar 32 allows a wide or narrow grip to be used, again allowing emphasis on different muscle groups. During the exercise the distance between the hands and feet of the user changes considerably. As the user raises and lowers his or her upper body in the direction of arrows A and B, lower body support 25 moves in the direction of arrows C or D respectively, facilitating a full and fluid exercise movement.

FIG. 3I (perspective view) illustrates the apparatus being used for assisted chin up exercises. Handles 29 are mounted in the highest position with bar 32 attached. The user is resting the ankles on lower body support 25 therefore decreasing the proportion of bodyweight lifted using the arm and back muscles and thus assisting himself or herself with the exercise. This illustration also shows how handles 29 and the angle of struts 17 ensure the user can exercise without interference from the apparatus.

FIG. 3J (perspective view) illustrates the apparatus being used for chin up exercises using chin up bar 22. The angle of struts 17 ensures the user can exercise without interference from the apparatus. FIG. 3I and FIG. 3J illustrate how the apparatus allows progressively more difficult exercises.

FIG. 3K (side perspective view) illustrates the apparatus being used for crunch exercises to target the upper abdominal muscles.

FIG. 3L (side perspective view) illustrates the apparatus being used for abdominal curl exercises by moving lower body support 25 in the direction of arrows C, D.

FIG. 3M (rear perspective view) illustrates the apparatus being used for sit-up exercises using bar 37 attached between struts 18.

FIG. 3N (side perspective view) illustrates the apparatus being used for hip raise exercises using the muscles of the lower back. As the user raises and lowers the hips in the direction of arrows A, B, lower body support 25 moves in the direction of arrows C, D respectively, allowing a full and fluid exercise movement.

FIG. 3O (perspective view) illustrates the apparatus being used for back extension exercises using strap 38 and bar 37 releasably attached between struts 18. The angle of struts 18 allows strap 38 to be positioned forward of bar 37. This arrangement allows the user to incline his or her body by resting the thighs on strap 38 with the ankles against bar 37. The user exercises the muscles of the lower back by raising and lowering the upper body in the direction of arrows A, B.

FIG. 3P (side perspective view) illustrates the apparatus being used for one legged squat exercises to target the quadriceps and gluteus muscles. The position of handles 29 relative to lower body support 25 allows the user to balance and exercise safely.

FIG. 3Q (side perspective view) illustrates the apparatus being used for lunge exercises to target the quadriceps, gluteus and hamstring muscles. Lower body support 25 moves in the direction of arrows C, D as the user to stretches out and then recovers.

ALTERNATIVE FOLDING EMBODIMENT

FIG. 4 (perspective view) shows an alternative embodiment of the present invention. This embodiment includes means by which the apparatus may be folded for storage, and may therefore be considered more suitable for the home environment. Rigid struts 61, constructed of suitably strong material such as steel, are attached via bracket and pivot pin hinge assemblies 65 at end portions to the rear face of cross member 68. Rigid members 62 are connected via hinge assemblies 64 to the rear face of cross member 67. Members 62 extend approximately midway along the length of struts 61, and are connected to struts 61 by hinge assemblies 63. Spring loaded locking pins 66 (of the type commonly used on gymnasium equipment) are mounted on the underside of struts 61 oriented to spring rearwards and engage apertures (not shown) in the forward face of cross member 67. Struts 61 extend sufficiently forward of cross member 67 such that when locked in place by spring pins 66 they ensure that the apparatus may not tip forward when in use and in particular when downward pressure is applied to handles 29 (in doing this struts 61 perform a similar function to extensions 12 of the embodiment in FIG. 1). Height adjustable feet 73 mounted at forward portions of struts 61 ensure contact with the support surface and thus prevent undue movement of the apparatus. Additionally the assemblies of struts 61, members 62 and spring pins 66 prevent cross members 68 and 67 moving apart or together when the apparatus is set up for use. Small wheels or castors 74 are connected via bolts through short tubes welded on the forward edge of cross member 67. Wheels 74 are in contact with the support surface to aid the movement of cross member 67 when being folded for storage.

Struts 69 are connected via pivot means to struts 72. Pivot pins 71 pass through steel brackets 75 and through suitably reinforced apertures in the top of struts 69. The steel brackets have a rounded configuration below the pivot point, and the top of struts 69 have a rounded configuration above the pivot point in order to prevent any cutting edges being formed. Pivot pins 71 contain threaded end sections for receiving hand-tightened nuts 71A. Nuts 71A may be tightened to secure struts 69 in vice like grips between brackets 75, thus forming secure connections when the apparatus is set up for use.

Struts 72 may be shorter than struts 17 of the embodiment shown in FIG. 1, thus the overall height of this embodiment may be lower, and more suitable for home use (by shortening the unsupported part of the upper portion of struts 72 the need for an equivalent reinforcing strut to strut 19 embodiment shown in FIG. 1 may be negated). Alternatively, in a modification to allow greater overall height of the embodiment shown in FIG. 4 a releasable, such as pivotably connected, reinforcing strut between upper portions of struts 72 and struts 69 may be desirable. In the embodiment shown in FIG. 4 no cushioning on the base or support surface is shown. It may be desirable to include a cushioned mat or mats, such as a gym mat to the same purpose as boards 35 and 36 of the embodiment shown in FIG. 1.

OPERATION OF THE ALTERNATIVE EMBODIMENT

Exercises are performed on this embodiment in the same or similar manner as illustrated in FIGS. 3A to 3Q (including the use of bar 32, strap 38, and cushioned rigid tube 37 illustrated in FIG. 1).

To fold the embodiment illustrated at FIG. 4 for storage, firstly hand-tightened nuts 71A are loosened to allow struts 69 and 72 to be folded together. The user then disengages spring pins 66 (arrow E) and lifts struts 61 upwards (arrow F). By doing this struts 61 pivot about their hinged attachments 65 to cross member 68. As a result struts 61 via members 62 draw cross member 67 towards cross member 68 with the assistance of wheels 74. Thus struts 72 are folded towards struts 69 (arrow G). The apparatus is secured in a folded condition via catch 70 hooking over lug 70A.

ADDITIONAL FOLDING EMBODIMENT WITH INCLINABLE SIT-UP BOARD

FIG. 5A (side elevational view) illustrates an additional embodiment of the apparatus, incorporating both means to fold the apparatus and an inclinable sit-up board. Sub-frame 87 is pivotably connected 89 at an end portion to the rear face of cross member 88. Sub-frame 87 comprises a front frame 87A forwards of cross member 83. Spring loaded locking pin 81 is mounted on the side of front frame 87A and oriented to spring rearwards engaging tube 81A welded to the top surface of cross member 83.

Front frame 87A extends sufficiently forward of cross member 83 such that when locked in place by spring pin 81 the apparatus may not tip forward when in use or when downward pressure is applied to handles 29. Height adjustable feet 80 mounted at forward portions of front frame 87A ensure contact with the support surface and thus prevent undue movement of the apparatus. Cushioned board 105 is secured to front frame 87A for the users comfort.

Strut 85 is pivotably connected via brackets and pivot pin 84 to the rear face of cross member 83 and via similar pivotable means 86 to an approximate mid-point of sub-frame 87. By these connections the assembly of sub-frame 87, strut 85 and spring pin 81 prevent cross members 83 and 88 moving apart or together when the apparatus is set up for use. Small wheel or castor 82 is mounted on the forward edge of cross member 83 and in contact with the support surface to aid the movement of strut 103 when the apparatus is being folded for storage.

Sit-up board frame 96 is connected via pivot means 104 to sub-frame 87 such that it may be inclined as shown. Member 95 is pivotably attached to frame 96 and engages ridges 94 by virtue of its inverted L-shape (when viewed in rear elevation) to incline the frame 96 at a variety of angles to the horizontal. Ridges 94 are made of suitably strong material, such as moulded plastic, and bolted to the rear face of strut 103A. Cushioned board 96A is secured to sit-up board frame 96 for the users comfort. By inclining the sit-up board frame 96 a user increases the difficulty of sit-up exercises (illustrated at FIG. 3M).

Assembly 92 is slotted into a sleeve 90 welded at an end portion of frame 96 and secured via a spring pin 91. Assembly 92 has a T-shape when viewed in rear elevation and is used to secure a user's feet, performing the same or similar function to cushioned tube 37 illustrated in use in FIGS. 3O and 3M. Foam padding 93 cushions the top bar of the assembly for the comfort of the user.

Tubular extension 100 is sleeved inside strut 103, allowing the height of the chin up bar 22 to be lowered for storage. Metal or plastic insert (not shown) inside strut 103 ensures a snug fit for extension 100. Hand-tightened bolt 97 tightens against depressions 99 in extension 100 to rigidly secure chin up bar 22 at the chosen height. Spring loaded studs 98 are placed inside the tubular extension 100 and protrude from apertures in the walls of the extension. These studs need to be depressed by the user to lower the extension 100 inside strut 103 and thus ensure that the extensions are lowered under control. The insert (not shown) surrounding the extension 100 inside the strut 103 has bevelled bottom edges to ensure the studs 98 do not lock the extensions in a lowered position. Chin up bar 22 may be welded or bolted to extension 100. Pulley 27 is mounted at an upper portion of extension 100 and performs the same function as in the embodiment shown in FIG. 1. It may be advantageous to include a releasable reinforcing strut 100A between extension 100 and strut 103A. Reinforcing strut 100A is pivotably connected via a bracket and pin assembly 100B to strut 103A. When the apparatus is set up for use strut 100A is locked to extension 100 via spring loaded studs protruding from extension 100 engaging apertures in the sides of reinforcing strut 100A, the upper portion of strut 100A being shaped or cut to allow it to fit around extension 100.

Strut 103A is pivotably connected via pivot pin 71 and steel brackets 75 to strut 103. Hand-tightened bolt 71A on a threaded end of pivot pin 71 ensures a secure connection when the apparatus is set up.

In this embodiment handle fixings 102, moulded of suitably strong material such as plastic or nylon are shaped to fit around strut 103 as means of attaching handle 29. Fixings 102 are two piece assemblies and are clamped around struts 103 using nuts and bolts. Advantageously such mouldings may save the time required to weld tubular sleeves 33A to D of the embodiment shown in FIG. 1. In addition using mouldings avoids the distortion caused by welding, and further allowing a measure of choice in positioning. They may however be less robust than tubular steel sleeves.

Referring to FIG. 5B there is shown a rear elevational view of the inclinable sit-up board of the apparatus of FIG. 5A. Pivotable connection 89 (of FIG. 5A) between sub-frame 87 and cross member 88 comprises tubular sleeves 89A welded at an upper part of the rear face of cross member 88 in a horizontal orientation. Tubular sleeves 89B are welded at an end portion of sub-frame 87 in the same orientation as sleeves 89A. Steel rod 89C passes through sleeves 89A and 89B, and is bolted at either end, thus pivotably connecting sub-frame 87 to cross member 88.

Inverted L-shape members 95 are pivotably attached to sit-up board frame 96 via bolts 95A passing through tubular sleeves welded to the underside of the frame 96. L-shaped members 95 sit in the angle formed by the ridges 94 and struts 103A to incline the sit-up board frame 96. T-shaped member 92 is shown slotted inside sleeve 90 and secured by spring pin 91.

Referring to FIG. 5C there is shown a top plan view of the folding assembly of the apparatus of FIG. 5A. Sub-frame 87 is pivotably connected via steel rod 89C to tubular sleeves 89A on the rear face of cross member 88. Front frame 87A extends forward of cross member 83 and is secured in place by spring pins 81 engaging tubes 81A welded on the top of cross member 83. Struts 85 are pivotably connected via brackets and pivot pins 84 to the rear face of cross member 83 and via similar means 86 to an approximate mid-point of sub-frame 87. Small wheels or castors 82 are mounted on the front face of cross member 83 and in contact with the support surface to aid the apparatus to be folded for storage. Sit-up board frame 96 is pivotably connected 104 to sub-frame 87 via bolts engaging tubular sleeves.

OPERATION OF THE ADDITIONAL FOLDING EMBODIMENT

Exercises are performed on embodiments having the foldable frame construction shown in FIG. 5A in the same or similar manner as illustrated in FIGS. 3A to 3Q (including the use of bar 32 and strap 38 illustrated in FIG. 1). However, cushioned T-shape assembly 92 performs the same or similar function of cushioned rigid tube 37 of FIG. 1. Beneficially however the inclinable sit-up board frame 96 allows variation in the difficulty of sit-up exercises.

Referring to FIG. 5D there is shown a side elevational view of the frame of FIG. 5A in a folded configuration. Hand-tightened nut 71A is released to allow strut 103 to be folded toward strut 103A. Reinforcing strut 100A is released from its attachment to extension 100 and folded down. Hand-tightened bolt 97 released to allow extension 100 to be slid down inside strut 103. Sub-frame 87 is lifted up, lifting up sit-up board frame 96 at the same time, and draws in strut 103 via strut 85 and cross member 83. The apparatus is secured in a folded condition via catch 70 hooking over lug 70A.

FURTHER FOLDING EMBODIMENT WITH INCLINABLE SIT-UP BOARD

Referring to FIG. 6A there is shown a further example of a folding embodiment of the apparatus.

Strut 118 is pivotably connected via pivot pin 71 to brackets 126 and thus to strut 122. Pivot pin 71 has a threaded end section for receiving hand-tightened nut 71A. The nut 71A may be tightened to secure strut 118 in a vice like grip between brackets 126, thus forming secure connections when the apparatus is set up for use.

Sit-up board frame 96 is pivotably connected to cross member 111 via a pivotable connection 124 (similar to the pivotable connection 89 of FIG. 5A). Pivotable connection 124 is comprised short lengths of steel tube (not shown) welded on the top surface of cross member 111, oriented along the length of cross member 111 and flush with the rear face. Similar short lengths of steel tube (not shown) are welded to the underside of sit-up board frame 96 and flush with the end. A steel rod (not shown) is sleeved through the steel tubes on cross member 111 and sit-up board frame 96 to connect them. Cushioned T-shape assembly 92 is mounted at an end portion of frame 96 to secure a user's feet when exercising.

Struts 113 and 115 are pivotably connected to each other and to cross members 111 and 117 respectively via bracket and pivot pin assemblies 114, 112 and 116. By being so connected struts 113 and 115 prevent cross members 111 and 117 from moving together or apart when the apparatus is set up for use. A length of nylon strap 125 is connected between the underside of sit-up board frame 96 and pivot 114. Nylon strap 125 is of the correct length such that when sit-up board frame 96 is raised up beyond the highest elevation for incline sit-ups, the strap tightens and lifts struts 113 and 115 at pivot 114, thus drawing cross member 117 towards cross member 111 and folding the apparatus.

A frame 110 (similar in shape and size to front frame 87A of FIG. 5C) is welded to the front of cross member 111 to prevent the apparatus tipping forward when in use. Frame 110 may alternatively be connected to cross member 111 by similar pivotable means as pivotable connection 124 described above. In this instance when the apparatus is set up for use the frame 110 would be secured via a similar arrangement to spring pin 81 and tube 81A of FIGS. 5A and 5C and by being so secured frame 110 would stabilise the apparatus. Further still, separate extendable and retractable stabilising extensions may potentially be used.

Chin up bar 22 is connected to extension 119. Extension 119 is secured at a selected height via bolts 121. Threaded apertures 120 provide a choice of height for the chin up bar 22 dependant on the preference of the user and ceiling height. To facilitate this telescopic extension, pulley 27 is mounted via a bolt through a tubular steel sleeve welded on the rear face of strut 122.

A catch 70 and lug 70B are included to secure the frame in a folded configuration.

OPERATION OF FURTHER FOLDING EMBODIMENT

Exercises are performed on this embodiment in the same or similar manner as illustrated in FIGS. 3A to 3Q (including the use of bar 32 and strap 38 illustrated in FIG. 1). However cushioned T-shape assembly 92 performs the same or similar function of cushioned rigid tube 37 of FIG. 1. Beneficially however the inclinable sit-up board frame 96 allows variation in the difficulty of sit-up exercises.

Referring to FIG. 6A when being folded for storage hand-tightened nut 71A is loosened, and sit-up board frame 96 lifted in the direction of arrow H. Strap 125 tightens and lifts struts 113 and 115 which pivot upwards and fold about their connection 114. In doing this cross member 117 is thus drawn towards cross member 111. The apparatus is secured in a folded state via catch 70 and lug 70B.

Referring to FIG. 6B there is shown a side elevational view of the frame of the embodiment of FIG. 6A in its folded state. As in this folded state the embodiment rests on the forward edge of frame 110, strut 118 is of sufficient length to compensate and provide stability in the folded state. From this view it may be seen that pivotably connecting frame 110 to cross member 111 may be advantageous for storage of the apparatus, though would require means to secure frame 110 in place, or provide alternate stabilising means, for when the apparatus is set up for use.

RAMIFICATIONS

Some examples of further ramifications follow. Referring to FIG. 1, in a further embodiment, possibly for home use, the configuration of side frames 21 may be altered, for example; struts 17 may be shortened, thus lowering overall height of the apparatus, thus struts 19 and steps 20 may be eliminated.

Base frame 11 may be altered in any number of ways, provided it provides stability for side frames 21 and in particular as long as stabilising means are provided to stop the apparatus tipping forward. For example extensions 12A may be eliminated to reduce the footprint of the apparatus. Extensions 12 may extend substantially forward. Potentially only one forward stabilising extension may be used in any embodiment. Stabilising extensions may potentially be connected to lower portions of struts 17 and extend substantially forward and down to the support surface. Struts 15 may be replaced by one or several struts extending between cross members 13, 13A. Alternatively struts 15 may be replaced by, or complemented by, substantially parallel struts extending between struts 17 and 18 to perform a similar function of counteracting levering forces. Cross members 13 and 13A and struts 15 may be replaced by struts extending front to rear, with side frames 21 mounted on those struts. Those struts may then be separately connected by cross members or a member. Side frames 21 may even potentially be bolted directly to a support surface, such as a gym floor, negating the use of base frame 11. In other embodiments when set up for use a length of between 1.8 and 2.8 meters for struts 17 or their equivalents may be suitable. A horizontal distance between struts 17 of side frames 21 of between 50 and 100 centimeters may be conceivable if a handle design allows (a narrow distance such as 50 centimeters between side frames may be potentially suitable in an embodiment for children).

Boards 35, 36 if constructed with sufficiently strong materials may form a stressed part of any base frame, for example replacing or complementing struts 15 and extensions 12 in forming a rigid and stable base frame. Boards 36 and 35 may potentially be made as a one piece moulded construction. Alternatively, boards 35, 36 may potentially be replaced by a flexible cushion or mat, placed directly on the floor, and shaped to cover any cross members or struts of any base frame.

Board 36 may be provided with means such as hooks allowing it to be inclined by attachment to bar 37 for inclined sit-ups, with bar 37 connected between struts 18. Alternatively in a modification the apparatus of FIG. 1 may be provided with an inclinable sit-up board operating in a similar way to sit-up board frame 96 and associated components of FIGS. 5B and 6.

A slight taper or narrowing of the distance between side frames 21 towards the upper part of the apparatus may be feasible and potentially desirable for such exercises as dips. In this case a modification allowing lugs 32A to be attached via sleeves to bar 32 may be required. This would allow bar 32 to be attached to handles 29 even where the distance between the handles 29 varies.

Continuing to refer to FIG. 1 alternative means for raising, lowering and securing the lower body support 25 may include using jamming cleats or hooks or buckles or any slidably adjustable means on any part of the frame or any suspending means. This may include attaching cords 26 to a sleeve and spring pin arrangement potentially mounted on any strut of the side frames 21 with compensating modifications if required. These may include potentially incorporating additional struts or members possibly located between struts 17 and 18 of the side frames for mounting such slidably adjustable means. A further embodiment may potentially replace cords 26 with rigid or semi-rigid suspending means, such as elongate plastic or aluminium members.

These may be pivotably connected to struts 17 at a similar location to pulleys 27, with a simple counterweight system above the pivot connection. Lower body support 25 may be connected to such members via slidable sleeves, and secured at varying heights via spring pins engaging apertures on the members. Cords 26 may potentially be replaced by straps or wire rope. Lower body support 25 may have a different shaped cushioning element.

Handles may potentially be mounted on the struts and raised or lowered via sliding sleeve means, and locked in position with spring pins. This type of arrangement is common on gymnasium equipment. This may require means of securing the lower body support 25 to be relocated on the apparatus. Handles may be of a different design, such as provided with additional struts to support any cantilever and thus giving extra strength. The means by which the handles are mounted may alternatively comprise moulded plastic or machined metal parts, screwed, bolted or clamped in position, to provide a similar function to sleeves 33A to 33D of FIG. 1. Using means such as these may avoid the distortion caused by welding sleeves directly to struts. Further embodiments of any handles may project conceivably up to 60 centimeters forward of the face of the struts, given any necessary reinforcement or support.

The struts and members of the base frames and side frames of any embodiments may be constructed of any material of sufficient strength to withstand the rigors demanded of exercise apparatus. Struts and members may be of different cross sectional shapes, such as rectangular, oval, or round, though modifications as to how the handles 29 are mounted would be required Referring to FIG. 4, in further embodiments, for example, struts 72 and cross member 67 may potentially be formed from one bent piece of material, such as steel tube and likewise struts 69 and cross member 68. Struts 61 and associated components may be replaced by one robust strut centrally located between the side frames and with a cushioned board mounted on it. A rigid cushioned board of sufficient strength may alternatively be used to perform the same function as struts 61. Alternatively the assemblies comprising struts 61, members 62, spring pins 66, feet 73 and hinges 63, 65, 64 may be placed between the two side frames formed by struts 72 and 69. A rigid cushioned board or boards may then be attached to the top of those assemblies. Potentially only one spring pin assembly may be required.

Referring to FIG. 5A, various methods may be viable for adjusting the height of any collapsible embodiment of the apparatus, such a using pivotably mounted, as opposed to telescopic extensions. These may be pivoted upwards and secured in position when the apparatus is set up for use.

In all foldable embodiments any suitable pivoting means between members may be used provided no cutting edges are formed and may be located anywhere on the members that allow the range of movement or folding capability required. In all embodiments welds may potentially be replaced by nuts and bolts or other suitable strong and rigid connecting methods, and vice versa. In all embodiments aspects of other embodiments may potentially be incorporated.

SCOPE OF THE INVENTION

Although the descriptions above contain much specificity, these should not be construed as limiting the scope of the invention but as merely providing illustrations of some of the presently preferred embodiments of this invention. Thus the scope of the invention should be determined by the appended claims and by their legal equivalents, rather than by the examples given.

I claim:

1. An adjustable exercise apparatus comprising when set up for use;

a. a pair of side frames each comprising at least one fixed inclined elongate member forwardly positioned on the side frame and inclined towards a rearward portion of the apparatus, and b. at least one cross member located at a base portion of the apparatus whereby said side frames are maintained in a secure opposed arrangement and whereby permitting a user to move through the opening between the side frames c. at least one pair of handles comprising rigid elongate portions projecting in substantially forward directions from first ends adjacent to said inclined elongate members to second free ends whereby a user is able to hold and use said rigid elongate portions from above without interference by the apparatus d. a plurality of mountings to fix said handles at a plurality of height positions on said side frames whereby said rigid elongate portions project as claimed e. a pendulous member suspended via at least one slender elongate flexible structure whereby said pendulous member is located in the opening between said side frames, and f. said pendulous member located in a posterior portion of the apparatus relative to a plurality of positions for said handles, and g. said pendulous member movable between and securable at various height positions via said at least one slender elongate flexible structure, and h. at least one height position for said pendulous member being higher than at least one height position for said handles and whereby a user may perform at least the following bodyweight exercises on the apparatus; push ups, assisted push ups, decline push ups, incline push ups, dips, assisted dips, bodyweight rows, decline bodyweight rows, assisted chin ups, abdominal curls, hip raises, one legged squats, lunges.

2. The apparatus of claim 1 wherein;

a) at least one fixed inclined elongate member forwardly positioned on the side frame and inclined towards a rearward portion of the apparatus is inclined between 55 and 80 degrees from the horizontal, and b) the overall measurement along said at least one fixed inclined elongate member from the base of said side frame at a forward portion of the apparatus to the top of said side frame at a rearward portion of the apparatus is between 1.8 and 2.8 meters when the apparatus is set up for use.

3. The apparatus of claim 2 further including at least one elongate member located at upper portions of said fixed inclined elongate members whereby chin ups exercises are performed by a user unimpeded by the apparatus.

4. The side frames of claim 1 further including upwardly and downwardly adjustable extensions whereby the heights of said side frames are raised and lowered allowing said apparatus to be configured for use and storage.

5. The apparatus of claim 1 wherein a) said rigid elongate portions of at least one pair of said handles project between 20 and 60 centimeters substantially forward of said inclined elongate members, and b) at least part of said rigid elongate portions of said handles converge whereby providing a user with a choice of distance between his or her hands when exercising.

6. The apparatus of claim 1 wherein at least three height positions are provided for said at least one pair of handles with;

a) at least one position whereby said rigid elongate portions of said handles are less than 55 centimeters above the level of any exercising surface b) at least one position whereby said rigid elongate portions of said handles are between 20 and 90 centimeters above the level of any exercising surface c) at least one position whereby said rigid elongate portions of said handles are more than 90 centimeters above the level of any exercising surface.

7. The apparatus of claim 1 wherein the horizontal distance along a central axis of the apparatus from a point substantially level with and between the bases of said inclined elongate members to a point substantially under said pendulous member is between 50 and 110 centimeters.

8. The apparatus of claim 1 further including at least one of the following;

a) a demountable elongate member spanning between at least one pair of said handles whereby allowing variation in exercise b) a demountable flexible support securable across the opening between said side frames whereby permitting a user to perform back extension exercises c) a demountable elongate member with at least one cushioning element and securable on the apparatus whereby permitting a user to perform sit up and crunch exercises.

9. An adjustable exercise apparatus comprising when set up for use;

a) a pair of inclined elongate members spaced apart in a secure opposed relationship whereby a user can exercise in the opening between said inclined members, and b) said pair of inclined elongate members extending upwards and rearwards from a forward portion of the apparatus c) at least one cross member whereby said inclined elongate members are maintained in said secure opposed relationship d) at least one pair of handles comprising rigid elongate portions that project in substantially forward directions relative to said inclined elongate members, and e) said rigid elongate portions being sufficiently levelly disposed whereby a user is able to hold and use said rigid elongate portions from above, and f) said handles extending from first ends adjacent to said inclined elongate members to second ends, and g) said handles securable at a plurality of height positions via a plurality of mountings whereby said rigid elongate portions project as claimed h) a pendulous member suspended via at least one slender elongate flexible structure, and i) said pendulous member located rearwards on the apparatus relative to a plurality of said mountings for said handles, and j) said pendulous member movable between and securable at a plurality of positions at various heights via said at least one slender elongate flexible structure, and k) at least one height position for said handles being lower than at least one position for said pendulous member and whereby a user may perform at least the following bodyweight exercises; push ups, assisted push ups, decline push ups, incline push ups, dips, assisted dips, bodyweight rows, decline bodyweight rows, assisted chin ups, abdominal curls, hip raises, one legged squats, lunges.

10. The apparatus of claim 9 wherein the acute angles between said pair of inclined elongate members and the horizontal are between 55 and 80 degrees.

11. The apparatus of claim 9 wherein the overall measurement along the length of each of said inclined elongate members including any extensions is between 1.8 and 2.8 meters when the apparatus is set up for use.

12. The apparatus of claim 11 further including at least one elongate member at upper portions of said pair of inclined elongate members whereby chin ups exercises are performed by a user unimpeded by the apparatus.

13. The apparatus of claim 9 wherein the opening between said pair of inclined elongate members is between 50 and 100 centimeters wide.

14. The apparatus of claim 9 wherein said inclined elongate members are each supported by at least one further member inclined upwards and forwards from a rearward portion of the apparatus whereby a secure configuration is achieved.

15. The apparatus of claim 14 wherein said inclined elongate members are connected via at least one pivotable connection to their respective supporting members whereby a user can fold the apparatus for storage.

16. The apparatus of claim 9 wherein;

a) at least part of said rigid elongate portions of at least one pair of said handles converge whereby providing a user with a choice of distance between his or her hands when exercising, and b) wherein said handles project between 20 and 60 centimeters substantially forwards of said inclined elongate members.

17. The apparatus of claim 9 further including;

a) at least one position for said handles whereby said rigid elongate portions are less than 55 centimeters above the level of any exercising surface b) at least one position for said handles whereby said rigid elongate portions are between 20 and 90 centimeters above the level of any exercising surface c) at least one position for said handles whereby said rigid elongate portions are between 55 and 125 centimeters above the level of any exercising surface d) at least one position for said handles whereby said rigid elongate portions are more than 90 centimeters above the level of any exercising surface.

18. The apparatus of claim 9 wherein the horizontal distance along a central axis of the apparatus from a point substantially level with and between the bases of said inclined elongate members to a point substantially under said pendulous member is between 50 and 110 centimeters.

19. The apparatus of claim 9 further including at least one of the following;

a) a demountable elongate member spanning between said pair of handles whereby allowing variation in exercise b) a demountable flexible support securable on the apparatus whereby permitting a user to perform back extension exercises.

c) a demountable elongate member with at least one cushioning element and securable on the apparatus whereby permitting a user to perform sit up and crunch exercises.

20. The apparatus of claim 9 further comprising an inclinable cushioned exercising surface located at a base portion of said apparatus whereby a user can increase the difficulty of sit up exercises.

* * * * *